US007673956B2

(12) United States Patent
Izuo

(10) Patent No.: US 7,673,956 B2
(45) Date of Patent: Mar. 9, 2010

(54) PRINT HEAD INSPECTION METHOD, PRINT HEAD INSPECTION APPARATUS, AND PRINTER

(75) Inventor: Seiji Izuo, Shirojiri (JP)

(73) Assignee: Seiko Epson Corporation, Tokyo (JP)

( * ) Notice: Subject to any disclaimer, the term of this patent is extended or adjusted under 35 U.S.C. 154(b) by 607 days.

(21) Appl. No.: 11/601,816

(22) Filed: Nov. 20, 2006

(65) Prior Publication Data

US 2007/0188538 A1 Aug. 16, 2007

(30) Foreign Application Priority Data

Nov. 18, 2005 (JP) ..... 2005-333980

(51) Int. Cl.
*B41J 29/38* (2006.01)

(52) U.S. Cl. ..... 347/14

(58) Field of Classification Search ..... 347/19, 347/9, 11, 12, 14, 5, 47
See application file for complete search history.

(56) References Cited

U.S. PATENT DOCUMENTS

2007/0076029 A1* 4/2007 Komatsu ..... 347/9

FOREIGN PATENT DOCUMENTS

JP 59-123673 A 7/1984

* cited by examiner

*Primary Examiner*—K. Feggins
(74) *Attorney, Agent, or Firm*—Sughrue Mion, PLLC

(57) ABSTRACT

When an actually measured voltage Vsu detected by a voltmeter 58 is within an inspection permissible range, a print head inspection apparatus 50 performs an inspection as whether or not ink has been normally ejected, on the basis of a changes in voltage that occur in an inspection area 52 as a result of ejected ink droplets. On the one hand, when the actually measured voltage Vsu is less than the inspection range, the apparatus increases a relative distance between a nozzle plate 27 and the inspection area 52 by separating the capping member 41 from the print head 24, by then bringing the capping member 41 and the print head 24 into contact, and after a suction pump 45 performs a separated-suction process, by then gradually separating the capping member 41 from the print head 24 until the actually measured voltage Vsu is within the inspection permissible range. Thus, a nozzle inspection as to whether or not the print recording liquid has been normally ejected can be carried out with a stable degree of accuracy.

19 Claims, 12 Drawing Sheets

PRINT HEAD INSPECTION METHOD, PRINT HEAD INSPECTION APPARATUS, AND PRINTER

BACKGROUND OF THE INVENTION

1. Field of the Invention

The present invention relates to a print head inspection method, a print head inspection apparatus and a printer.

2. Description of the Related Art

A print head inspection apparatus has traditionally been known that performs a nozzle inspection as to whether or not ink droplets have been ejected from a nozzle, by charging ink droplets that are ejected from a nozzle with a predetermined potential difference generated between a print head of an ink jet printer and an ink droplet-receiving area (an ink-receiving area) that is provided opposite to the print head, thus causing the charged ink droplets to fly onto the ink receiving area, and detecting a change in voltage (induced voltage) that occurs in the ink-receiving area when the ink droplets reach the ink-receiving area (for instance, JP-A-59-123673).

SUMMARY OF THE INVENTION

However, in, for instance, the print head inspection apparatus disclosed in JP-A-59-123673, if, in some cases, ink droplets stick to the ink-receiving area and the print head, resulting in electrical connections among them, the electric current might leak by way of the ink droplets that have stuck, preventing the predetermined potential difference from being generated between the print head and the ink-receiving area. In such cases, nozzle inspections cannot be carried out with a stable degree of accuracy.

The present invention has been made in light of such a problem, and aims to provide a print head inspection method, a print head inspection apparatus and a printer that can perform a nozzle inspection as to whether or not the print recording liquid has been normally ejected with a stable degree of accuracy.

The present invention has adopted the following means to achieve the above object.

A print head inspection method of the present invention is a (print head inspection) method for inspecting a print head in which a nozzle-forming member forming a plurality of nozzles is provided by utilizing a print head inspection apparatus comprising a print recording liquid-receiving area that can receive print recording liquid ejected from the nozzles, the method including steps of:

(a) applying a predetermined voltage so as to generate a predetermined potential difference between the print recording liquid in the print head and the print recording liquid-receiving area;

(b) following step (a) detecting the potential difference between the print recording liquid in the print head and the print recording liquid-receiving area; and (c) when the potential difference detected in step (b) is within a predetermined permissible range, applying pressure sequentially to the print recording liquid in every nozzle, detecting an electrical change in the print recording liquid in the print head, or in the print recording liquid-receiving area, and on the basis of the electrical change detected, performing a nozzle inspection so as to establish whether or not print recording liquid has been ejected from individual nozzle.

In the print head inspection method, a nozzle inspection is performed in which pressure is generated sequentially in each nozzle and an inspection is made on the basis of an electrical change detected in the print recording liquid in the print head or the print recording liquid-receiving area, as to whether or not print recording liquid has been ejected from each individual nozzle, with a predetermined voltage applied so as to generate, when the detected potential difference between the print recording liquid in the print head and the print recording liquid-receiving area is within a permissible range, a predetermined potential difference between the print recording liquid in the print head and the print recording liquid-receiving area. Then, if, for instance, leakage of current occurs when the print recording liquid, or constituents derived from the print recording liquid, contact a nozzle-forming member and the print recording liquid-receiving area, a value of the potential difference between the nozzle-forming member and the print recording liquid-receiving area may not reach an expected level. In general, as an electrical field generated between the print head and the print recording liquid-receiving area weakens when a potential difference generated between the nozzle-forming member and the print recording liquid-receiving area drops, the degree of electrical change that occurs in the print recording liquid-receiving area or the print recording liquid in the print head diminished, thus the accuracy of nozzle inspection to deteriorate. Thus, the present invention sets in advance a permissible range of potential difference between the nozzle-forming member and the print recording liquid-receiving area, and, if the potential difference between the print recording liquid in the print head and the print recording liquid-receiving area detected is within the permissible range, performs the nozzle inspection. Consequently, a nozzle inspection of whether or not the print recording liquid has been ejected normally can be performed with a stable degree of accuracy. The "predetermined permissible range" herein may be a range within which accuracy of inspection can be secured, even if a potential difference detected between the print recording liquid in the print head and the print recording liquid-receiving area drops further than is normal.

In the print head inspection method of the present invention, the print head inspection apparatus comprises a distance-varying module that is capable of varying a relative distance between the print recording liquid-receiving area and the nozzle-forming member, and wherein, when the potential difference detected in step (b) is less than the permissible range, step (c) is a step of performing the nozzle inspection after the distance-varying module has been controlled so as to increase the relative distance.

In step (c) of the print head inspection method of the present invention, the predetermined potential difference has been generated between the print recording liquid in the print head and the print recording liquid-receiving area, and the nozzle-forming member and the print recording liquid-receiving area have in consequence assumed a normal inspection distance, when the potential difference detected in step (b) is less than the permissible range, step (c) is a step of controlling the distance-varying module so as to first increase the relative distance beyond the normal inspection distance and then restore it to the normal inspection distance, and, when the potential difference detected in step (b) is within the permissible range, of conducting the nozzle inspection at the normal inspection distance.

In the print head inspection method of the present invention, when the potential difference detected in step (b) is less than the permissible range, step (c) may be a step of controlling the distance-varying module so as to increase the relative distance until the potential difference detected in step (b) is within the permissible range.

In the print head inspection method, when the potential difference detected in step (b) is less than the permissible range, step (c) may be a step of defining the relative distance in such a way that the less the potential difference detected in step (b) is, the more the relative distance tends to increase, and of controlling the distance-varying module so as to reach the relative distance determined.

In the print head inspection method of the present invention, the print head inspection apparatus comprises a capping member that caps the nozzles by means of contact on the part of the nozzle-forming member, and a negative pressure generation module that generates negative pressure inside the capping member, wherein the print recording liquid-receiving area is provided inside the capping member, and the print head inspection method includes a step of:

(d) when results of the nozzle inspection indicates that the print recording liquid has not been ejected from the nozzles, after, by means of controlling the distance-varying module so that the capping member and the nozzle-forming member are brought into contact, capping the nozzle-forming member by means of the capping member, controlling the negative pressure generation module so that print recording liquid is sucked from the individual nozzle of the nozzle-forming member. Further step (c) may be a step of controlling the negative pressure generation module so as to generate negative pressure inside the capping member when the potential difference detected by the potential difference detection module is less than the permissible range. In order to generate negative pressure inside the capping member, the negative pressure generation module may be controlled so as to generate negative pressure inside the capping member by bringing the nozzle-forming member into contact with the capping member, or the negative pressure generation module may be controlled so as to generate negative pressure inside the capping member by separating the nozzle-forming member from the capping member.

In the print head inspection method of the present invention, the print head inspection apparatus comprises a capping member that caps the nozzles by means of contact on the part of the nozzle-forming member, and a negative pressure generation module that generates negative pressure inside the capping member, and wherein the print recording liquid-receiving area is provided in the capping member, the print head inspection method may includes a step of:

(e) when the potential difference detected in step (b) is less than the permissible range, controlling the negative pressure generating module so as to generate negative pressure in the capping member. Alternatively, the print head inspection apparatus comprises a capping member that caps the nozzles as by means of contact on the part of the nozzle-forming member, and a negative pressure generation module that generates negative pressure inside the capping member, and wherein the print recording liquid-receiving area is provided in the capping member, the print head inspection method may includes a step of:

(f) after controlling the distance-varying module in such a way that, when the potential difference detected in step (b) is less than the permissible range, the relative distance increases, controlling the negative pressure generation module so as to generate negative pressure on the capping member.

In the print head inspection method of the present invention, the distance-varying module may be a module that positions the print recording liquid-receiving area close to, or separated from the nozzle-forming member. Alternatively, the distance-varying module may be a module that positions the nozzle-forming member close to, or separated from the print recording liquid-receiving area The print head inspection apparatus of the present invention is a print head inspection apparatus for inspecting a print head in which is provided a nozzle-forming member forming a plurality of nozzles, a print head inspection apparatus comprising:

a print recording liquid-receiving area that can receive print recording liquid ejected from the nozzles;

a drive module that generates pressure on the print recording liquid in the print head;

a potential difference generation module that is capable of applying a predetermined voltage so that a predetermined potential difference is generated between the print recording liquid in the print head and the print recording liquid-receiving area;

a potential difference detection module that detects a potential difference between the print recording liquid in the print head and the print recording liquid-receiving area, an electrical change detection module that detects an electrical change in the print recording liquid in the print head, or in the print recording liquid-receiving area, and a control module that, when a potential difference detected by the potential difference detection module is within a predetermined permissible range while a predetermined level of voltage is applied by the potential difference generation module so as to generate the predetermined potential difference between the print recording liquid in the print head and the print recording liquid-receiving area, controls the drive module so that pressure is generated sequentially on the print recording liquid in individual nozzle and performs a nozzle inspection, on the basis of electrical change detected by the electrical change-detection module, in order to establish whether or not print recording liquid has been ejected from each individual nozzle.

In the print head inspection apparatus, a nozzle inspection is performed in which pressure is generated sequentially in each nozzle and an inspection is made on the basis of an electrical change detected in the print recording liquid in the print head or the print recording liquid-receiving area, as to whether or not print recording liquid has been ejected from each individual nozzle, with a predetermined voltage applied so as to generate, when the detected potential difference between the print recording liquid in the print head and the print recording liquid-receiving area is within a permissible range, a predetermined potential difference between the print recording liquid in the print head and the print recording liquid-receiving area. In this way, the present invention sets in advance a permissible range of potential difference between the nozzle-forming member and the print recording liquid-receiving area, and, if the potential difference between the print recording liquid in the print head and the print recording liquid-receiving area detected is within the permissible range, performs the nozzle inspection. Consequently, a nozzle inspection of whether or not the print recording liquid has been ejected normally can be performed with a stable degree of accuracy. In addition, this print head inspection apparatus may incorporate a variety of aspects of the print head inspection method described above.

A printer of the present invention comprises a print head in which a nozzle-forming member forming a plurality of nozzles is provided and the print head inspection apparatus described above. Since, as described above, the print head inspection apparatus of the present invention can perform a nozzle inspection as to whether or not a print recording liquid has been ejected normally with a stable degree of accuracy, the printer provided with this apparatus is also capable of achieving similar effects.

A program for the present invention is to cause a computer, or a plurality of computers, to implement the respective steps of the print head inspection method described above. The program may be recorded in a computer readable medium (such as a HDD, a ROM, an FD, a CD, or a DVD), may be delivered from one computer to another by way of a transmission medium (a communication network such as the Internet or a LAN), or may be given or received in any other form. Whether one computer executes the program, or a plurality of computers shares such steps and executes the individual steps involved, every step of the print head inspection method described above is carried out, and effects similar to those of the print head inspection method can thus be achieved.

DESCRIPTION OF THE PREFERRED EMBODIMENTS

Figure 1:
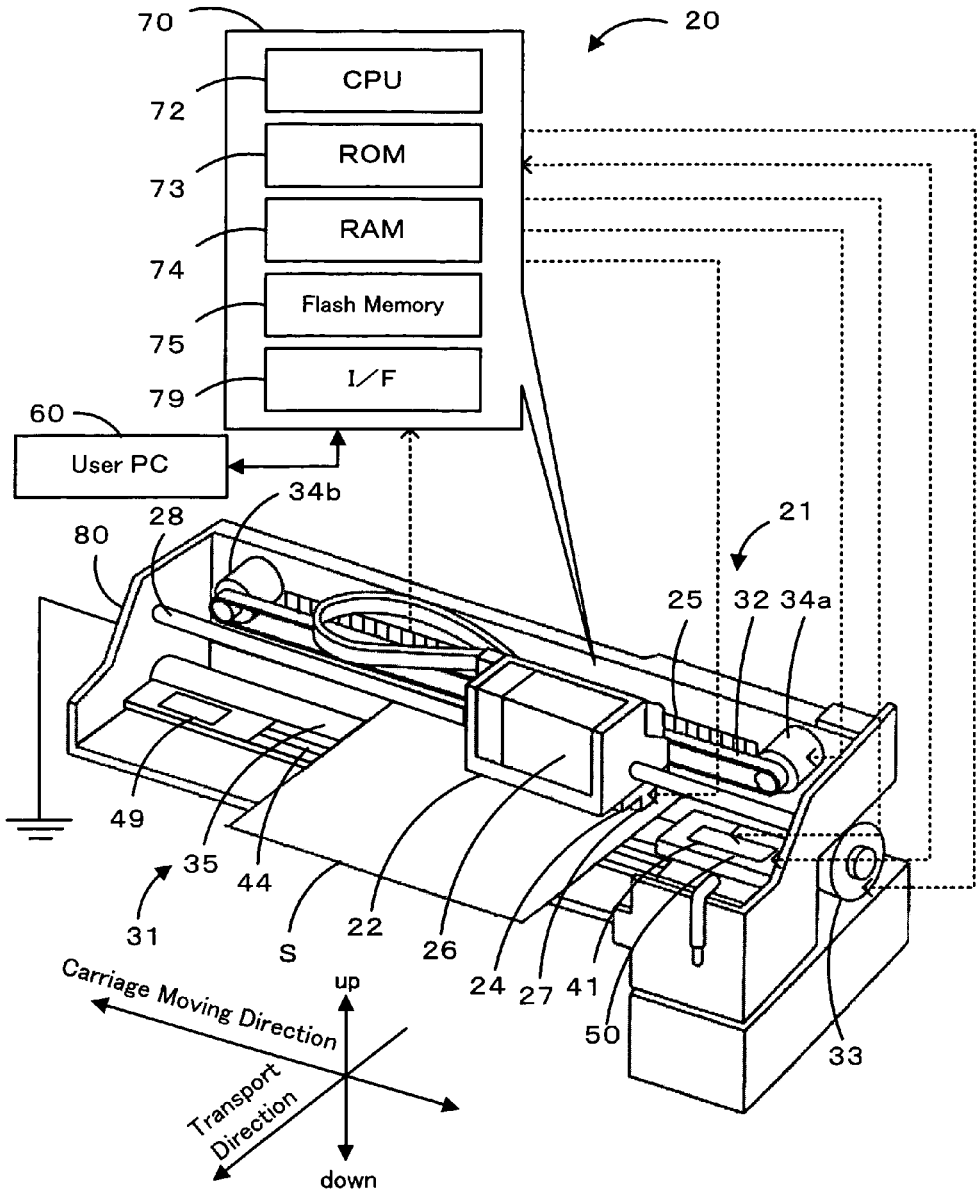
FIG. 1 is a block diagram illustrating an outline of a configuration of an ink jet printer 20.
Figure 2:
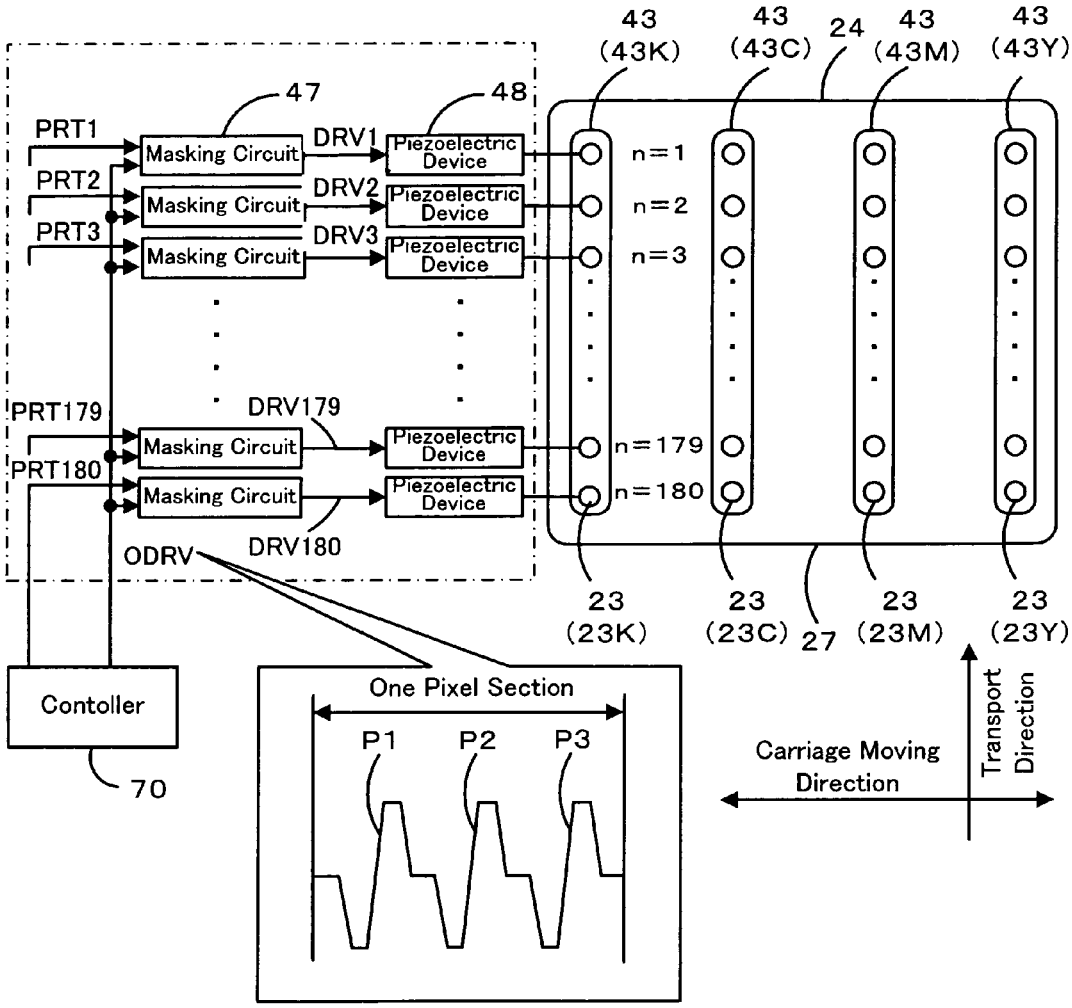
FIG. 2 is an illustration of a print head 24.
Figure 3:
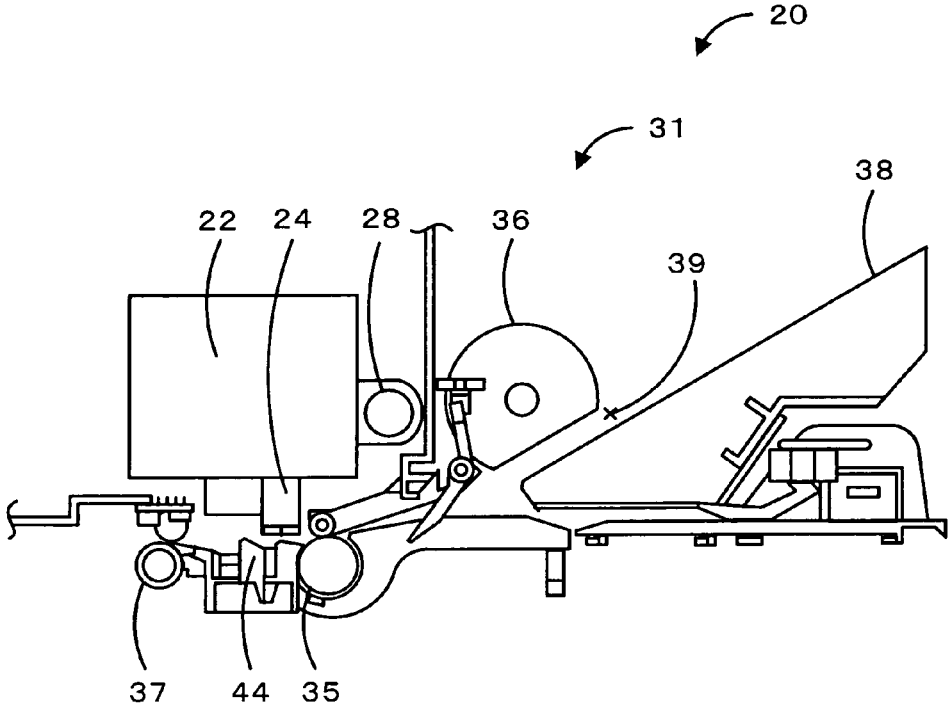
FIG. 3 is an illustration of a paper feed mechanism 31.
Figure 4:
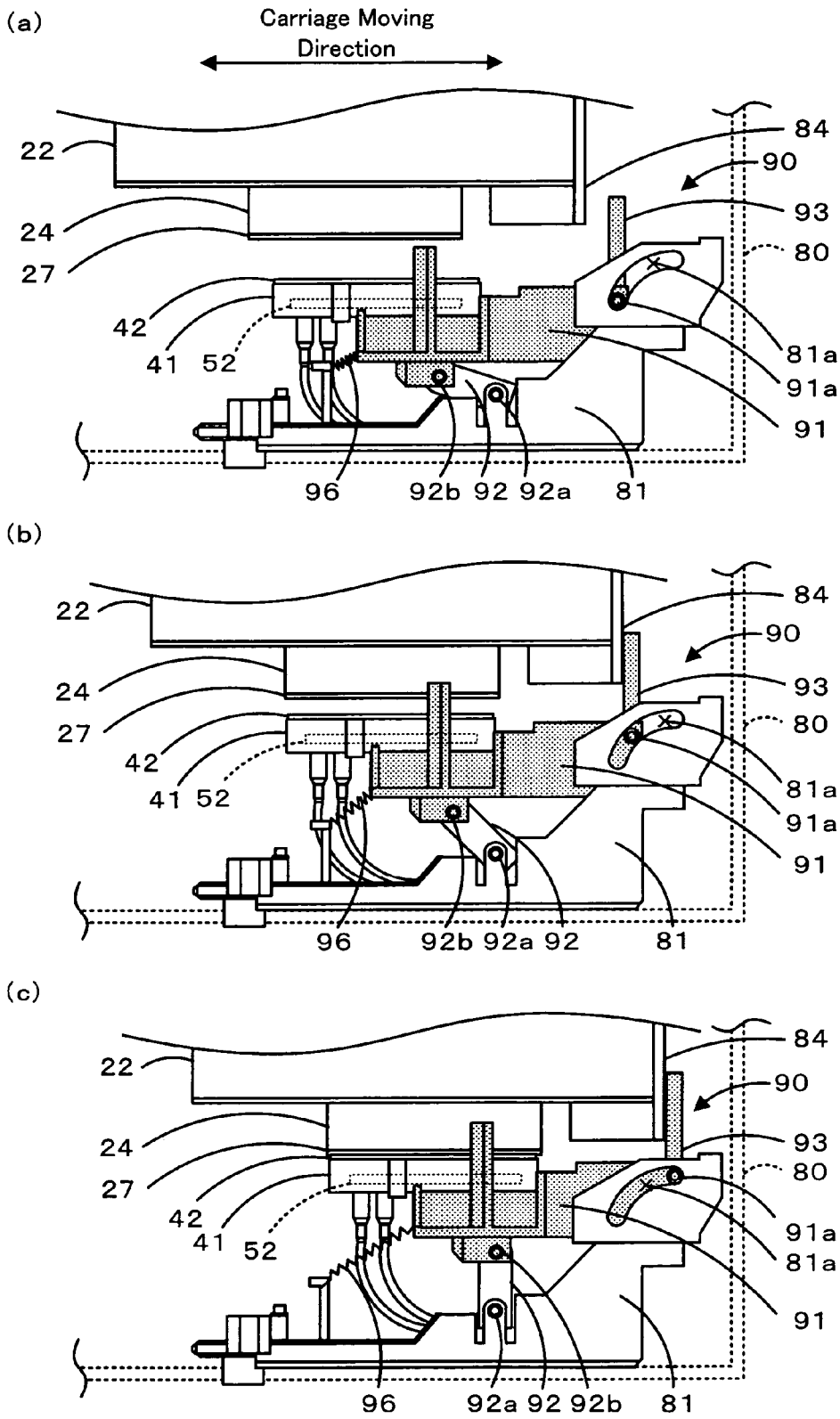
FIG. 4 is an illustration of a capping member elevation mechanism, FIG. 4(*a*) is a view of when a print head 24 is not opposed to a capping member 41, FIG. 4(*b*) is a view of when the print head 24 is opposed to the capping member 41, and when they are spaced apart, and FIG. 4(*c*) is a view of when the print head 24 abuts the capping member 41.
Figure 5:
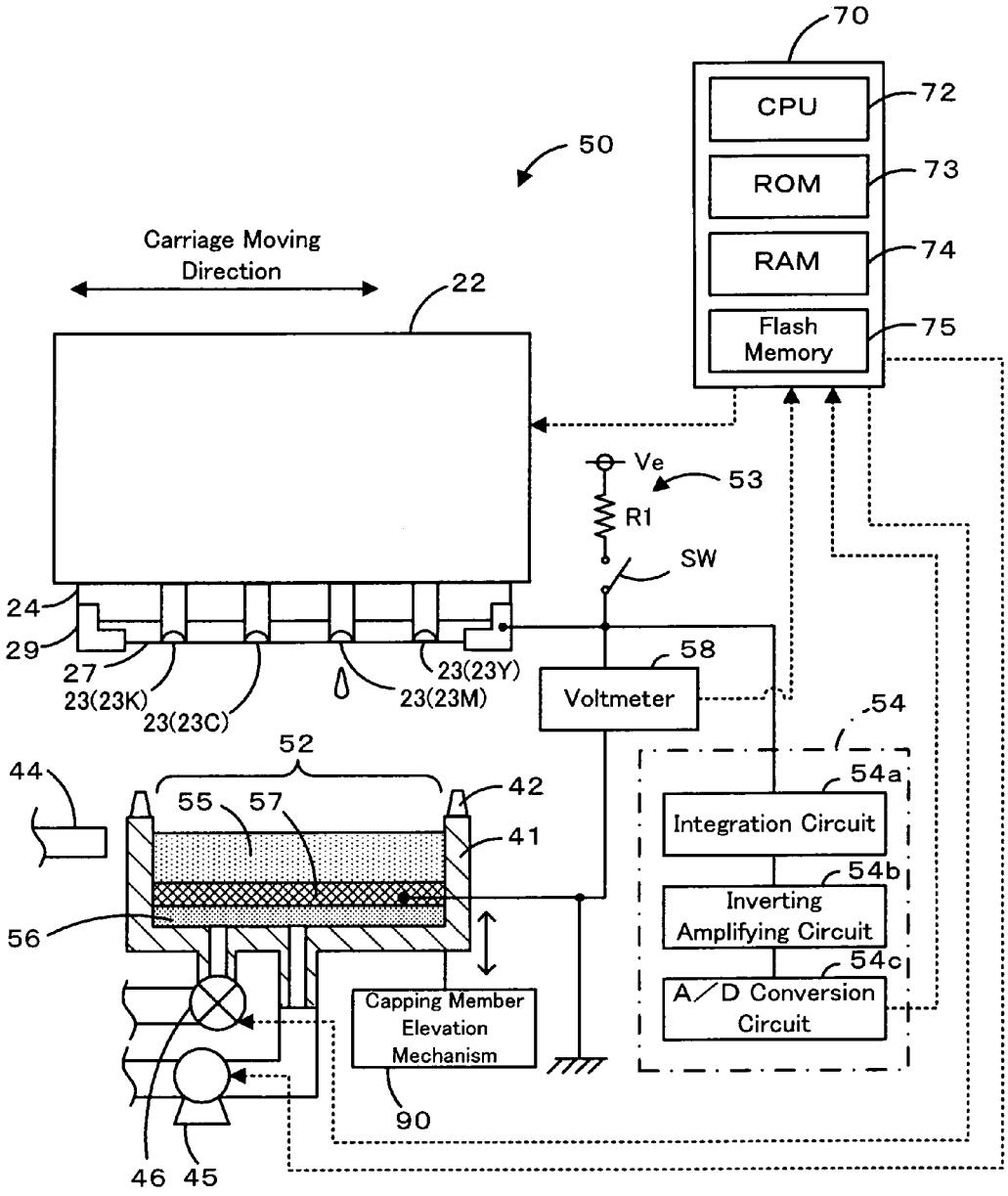
FIG. 5 is a block diagram illustrating an outline of a configuration of a print head inspection apparatus 50.

Next, one embodiment of the present invention will be described. FIG. 1 is a block diagram illustrating an outline of a configuration of an ink jet printer that is this embodiment. FIG. 2 is an illustration of an electrical connection of the print head 24. FIG. 3 is an illustration of the paper feed mechanism 31. FIG. 4 is an illustration of the capping member elevation mechanism 9, FIG. 4(*a*) is a view of when the print head 24 and the capping member 41 are not opposed to each other, FIG. 4(*b*) is a view of when the print head 24 is opposed to the capping member 41, and when they are spaced apart, and FIG. 4(*c*) is a view of a print head 24 abuts the capping member 41. FIG. 5 is a block diagram illustrating an outline of a configuration of the print head inspection apparatus 50.

As shown in FIG. 1, the ink jet printer 20 of this embodiment comprises a printer mechanism 21 that performs printing by ejecting ink droplets onto a recording sheet S that is carried over a platen 44 from the back to the front, in FIG. 1, a paper feed mechanism 31 including a paper feed roller 35 that is driven by a driving motor 33, a capping member elevation mechanism 90 for raising and lowering the capping member 41 formed adjacent to the right end of the platen, the print head inspection apparatus 50 that is formed inside the capping member 41 and that inspects whether or not ink droplets have been ejected normally from the print head, and a controller 70 for controlling the entire ink jet printer 20.

The printer mechanism 21 comprises a carriage 22 reciprocating from side to side along a guide 28 by means of a carriage belt 32, ink cartridges 26 mounted on the carriage 22 and individually containing inks of various colors, respectively yellow (Y), magenta (M), cyan (C), and black (K), and a print head 24 for applying pressure onto each ink supplied from the ink cartridges 26. The carriage 22 travels along the carriage belt 32, installed between a carriage motor 34*a* mounted on the right side of a mechanical frame 80, and a driven roller 34*b*, mounted on the left side of the mechanical frame 80, is driven by the carriage motor 34*a*. On the backside of the carriage 22 a linear encoder 25 is positioned for detecting a position of the carriage 22, and this enables control of a position of the carriage 22. The ink cartridges 26 comprise containers (not shown), respectively containing cyan (C), magenta (M), yellow (Y) and black (K) ink for printing, inks that are composed of water as solvents and dyes, or pigments, as colorants, and that can be attached to, and removed from, the carriage 22. In addition, a flashing area 49 is formed off a printable area at the left end of the platen 44. The flashing area 49 is used to carry out a so-called flashing operation that ejects ink droplets on a regular basis, or at predetermined timings and independent of printing data, in order to prevent ink at the tip of the nozzle 23 from drying and solidifying.

As shown in FIG. 2, the print head 24 comprises a nozzle plate 27, through which a plurality of nozzles 23 are perforated, fixed by a cover head 29 (See FIG. 5). In this context, all the nozzles are collectively referred to as nozzles 23; all the nozzle arrays 43 are collectively referred to as nozzle arrays 43; the cyan nozzle and the cyan nozzle array are respectively referred to as the nozzle 23C and the nozzle array 43C; the magenta nozzle and the magenta nozzle arrays are respectively referred to as the nozzle 23M and nozzle array 43M; the yellow nozzle and the yellow nozzle array are respectively referred to as the nozzle 23Y and the nozzle array 43Y; and the black nozzle and the black nozzle array are respectively referred to as the black nozzle 23*k* and nozzle array 43K. For purposes of the following description, a nozzle 23K is used. The print head 24 comprises a nozzle array 43K by arranging 180 nozzles 23K along a transport direction of the recording sheet S. A piezoelectric element 48 is provided within each nozzle 23K as a driving element for ejecting ink droplets, and ink is pressurized and ejected from the nozzles 23K by applying voltage to the piezoelectric element 48.

The print head 24 comprises a plurality of mask circuit 47 provided so as to correspond with the piezoelectric element 48 that drives the respective nozzles 23K. An original signal ODRV or a print signal PRTn generated by the controller 70 is entered into the mask circuit 47. The letter n at the end of the print Signal PRTn is a number that defines a nozzle included in a nozzle array. Since in this embodiment, a nozzle array consists of 180 nozzles, n is any integer value from 1 to 180. As shown in FIG. 2, within the spaces of one pixel (within the time in which the carriage 22 traverses an interval of one pixel) the original signal ODRV is composed of 3 drive waveforms of a first pulse P1, a second pulse P2 and a third pulse P3. In this embodiment an original signal ODRV having three drive waveforms as a repetition unit is referred to as one segment. When the original signal ODRV, or the print signal PRTn, is entered, on the basis of these signals, the mask circuit 47 outputs any necessary pulse of a first pulse P1, a second pulse P2 and a third pulse P3 as the drive signal DRVn (n means the same as that of the print signal PRTn), to the piezoelectric element 48 of the nozzles 23K. More specifically, when the mask circuit 47 outputs only a first pulse P1 to the piezoelectric element 48, one shot of ink droplets is ejected from the nozzles 23K, and small sized dots (small dots) are formed on the recording sheet S. In addition, when the mask circuit 47 outputs a first pulse P1 and a second pulse P2 to the piezoelectric element 48, two shots of ink droplets are ejected from the nozzles 23*k* and medium sized dots (medium dots) are formed on the recording sheet S. In addition, when the mask circuit 47 outputs the first pulse P1, the second pulse P2, and the third pulse P3 to the piezoelectric element 48, three shots of ink droplets are ejected from the nozzles 23K and large sized dots (large dots) are formed on the recording sheet S. In such away, the ink jet printer 20 can form 3 sizes of dots by adjusting the amount of ink to be ejected during the interval of one pixel. Considerations similar to those of the nozzles 23K and nozzle array 43K described above, apply to the other nozzles 23C, 23M, and 23Y, or to the nozzle arrays 43C, 43M and 43Y. In addition, although in this context the print head 24 adopts the method of pressurizing ink by deforming the piezoelectric element 48, it may also adopt a method of pressurizing ink by means of air bubbles generated by applying voltage to a heat element (such as a heater) and heating ink.

As shown in FIG. 3, the paper handling mechanism 31 comprises a recording sheet insertion port 39 through which a recording sheet S placed on the paper feed tray 38 is inserted; a paper feed roller 36 for supplying to the print head 24 the recording sheet S placed on the paper feed tray 38; a line feed roller 35 for carrying the recording sheet S or roll of paper; and a paper ejection roller 37 for ejecting a printed recording sheet S. The paper feed roller 36, the line feed roller 35 and the paper ejecting roller 37 are driven by the drive motor 33 (see FIG. 1) through a gear mechanism (not shown). A rotating drive force and frictional resistance of a separating pad (not shown) prevent more than one recording sheet S from being fed at one and the same time. In FIG. 1, a transport direction of the recording sheet S is a direction from the back to the front, and the moving direction of the carriage 22 that moves with the print head 24 is the direction (main scanning direction) orthogonal to the transport direction of the recording sheet S.

As shown in FIG. 4, the capping member elevation mechanism 90 comprises a capping member frame 81 fixed at the right lower end inside the mechanical frame 80, in the Figure, a connecting member 91, to which the capping member 41 is connected and which is supported so that it can travel below the carriage 22 and above the capping frame 81, a link arm 92 for movably supporting the connecting member 91, and a pulling spring 96 connected to the capping member frame 81 and the connecting member 91 and always pulling the connecting member 91 in the lower left direction in the Figure. In FIG. 4, to facilitate understanding, the connecting member 91 has been hatched. At one end of the connecting member 91 a columnar body 93 is provided that extends in an upward direction so that it can abut an abutting member 84 formed at the right end of the carriage 22, and above the other end the capping member 41 is provided opposite to the nozzle plate 27 when the abutting member 84 abuts the columnar body 93. In addition, a rod 91*a* is fixed adjacent to the columnar body 93. The link arm 92 is connected to the lower center of the connecting member 91 by way of a supporting shaft 92*b*. Into the other end of the link arm 92 has been inserted a turning shaft 92*a* that is fixed at practically the center of the capping member frame 81. Thus, the link arm 92 is configured so that it can turn around the turning shaft 92*a* while supporting the connecting member 91. On arcuate channel 81*a* is formed on both flanks of the capping member frame 81, and the rod 91*a* is fitted into the arcuate channel 81*a* so that it can travel along the shape of the channel. In the capping member elevation mechanism 90, when the carriage 22 travels to the right in the figure with the abutting member 84 abutting the columnar body 93, the capping member 41 ascends toward the print head 24 while the nozzle plate 27 surface of the print head 24 and the inspection area 52 surface in the capping member 41 are horizontally opposed to each other and travel to the right (See FIG. 4(*a*) to FIG. 4(*c*)). In addition, in the capping member elevation mechanism 90, when the carriage 22 travels to the left with the abutting member 84 abutting the columnar body 93, the capping member 41 descends a way from the print head 24 while the nozzle plate 27 surface and the inspection area 52 surface are horizontally opposed to each other and travel to the left.

As shown in FIG. 5, the print head inspection apparatus 50 comprises a capping member 41 having an inspection area onto which ink droplets that flow out of the nozzles 23 of the print head can land, a voltage application circuit 53 for generating a predetermined potential difference between the inspection area 52 and the print head 24, a voltage detection circuit 54 for detecting variations in voltage in the print head 24, and a voltmeter 58 for detecting a potential difference generated between the print head 24 and the inspection area 52.

The capping member 41, provided off to the right of the printable area of the platen 44 in FIG. 1, is an almost cuboid-shaped housing with the top opened, and a sealing member 42 made of insulating material such as silicon rubber is formed at the edge of the opening. The capping member 41 is used not only to inspect whether or not any nozzle is clogged, but also to seal the nozzles 23 so as to prevent them from drying at times when printing is halted. In addition, separately connected to the capping member 41 are a suction pump 45 and an opening and closing valve 46, and when the suction pump 45 is actuated while the opening and closing valve 46 is in a closed state, negative pressure is generated in the internal space of the capping member 41. Generation of negative pressure while the capping member 41 seals the nozzles 23 forcibly pumps ink out of the nozzles. In addition, a stretch tube is connected to the suction pump 45, or to the opening and closing valve 46.

The inspection area 52 comprises an upper ink absorber 55 onto which ink droplets directly land, a lower ink absorber 56 that absorbs ink droplets penetrating downward after landing on the upper ink absorber 55, and a mesh-like electrode member 57 located between the upper ink absorber 55 and the lower ink absorber 56. The upper ink absorber 55 is made of a conductive sponge so as to have the same potential as the electrode member 57, and its surface serves as the inspection area 52. The sponge is highly permeable so that landing ink droplets can promptly travel downward, and a urethane sponge of an ester series (product name: Ever Light SK-E, manufactured by Bridgestone Corporation) is used herein. The lower ink absorber 56 is made of a non-woven fabric such as felt that has a higher degree of retention of ink than the upper ink absorber 55, and a non-woven fabric (product name: Kinocloth, manufactured by OJI KINOCLOTH CO., LTD.) is used herein. The electrode member 57 is formed as a grid-like mesh made of stainless metal (for instance, SUS). Thus, ink that has once been absorbed by the upper ink absorber 55 passes through the gaps in the grid-like electrode member 57, and is then absorbed and retained by the lower ink absorber 56. The electrode member 57 is grounded to the ground through the mechanical frame 80 (see FIG. 1). As the electrode member 57 is in contact with the conductive upper ink absorber 55, the surface of the upper ink absorber 55, i.e., the inspection area 52, is also grounded to the ground, in a similar manner to the electrode member 57.

A voltage application circuit 53 is a circuit for intensifying voltage, amounting to a few volts, in electrical wiring laid inside the ink jet printer 20, to several tens or hundreds of volts, by means of a booster circuit (not shown), and by applying the intensified voltage to the nozzle plate 27 of the print head 24 by way of the cover head 29. In addition, as voltage is applied to the nozzle plate 27, voltage is applied to ink inside the print head 24. The voltage detection circuit 54 is connected so as to detect variations in voltage by way of the nozzle plate 27, and comprises an integration circuit 54*a* integrating and outputting voltage signals of the nozzle plate 27, an inverting amplifying circuit 54*b* for inverting amplifying and outputting signals outputted from the integration circuit 54*a*, and an A/D conversion circuit 54*c* for A/D converting and outputting signals outputted from the inverting amplifying circuit 54*c*. As a change in voltage caused by the flight or landing of a single ink droplet is weak, the integration circuit 54*a* integrates changes of voltage caused by the flight or landing of more than one ink droplet ejected from the same nozzles 23 and outputs in the form of a major change in voltage. The inverting amplifying circuit 54*b* not only inverts pluses and minuses of voltage changes, but also amplifies signals outputted from the integration circuit by means of a predetermined amplification rate, and outputs them. The A/D conversion circuit 54*c* converts an analog signal outputted from the inverting amplifying circuit 54*b* into a digital signal, and outputs it to the controller 70. In addition, the voltage amplifying circuit 54 and the voltage detection circuit 54 are connected to the conductive cover head 29 that fixes the nozzle plate 27.

As shown in FIG. 1, provided on the main board (not shown) attached to the rear surface of the mechanical frame 80, the controller 70 is configured as a microprocessor that is based on a CPU 72 and comprises a ROM 73, in which various types of processing programs are stored, a RAM 74, in which data are temporarily stored or saved, a flash memory 75 into which data can be written or from which data can be erased, Interface (I/F) 79 for exchanges of information with external appliances, and an input/output port (not shown). In addition, various processing programs as routines such as a main routine, a head inspection routine, a cleaning process routine or a printing process routine, all to be described later, are stored in the ROM 73. In addition, in the RAM 74 a print buffer area is provided in which print data sent from the user PC 60 through the I/F 79 can be stored. As well as a voltage signal outputted from the voltage detection circuit 54 of the print head inspection apparatus 50, a position signal from the carriage 22 from the linear encoder 25, or a voltage signal (see FIG. 5) from the voltmeter 58, etc., an item such as a print job outputted from the user PC 60 can also be entered into the controller 70 through the input port (not shown), through I/F 79. In addition, as well as a control signal to the print head (including a mask circuit 47 or a piezoelectric device 48), a control signal to the drive motor 33, a drive signal to the carriage motor 34*a*, an operation control signal to the suction pump 45, an opening or closing signal to the opening and closing valve 46, or a control signal to the voltage application circuit 53, etc., print status information outputted to the user PC 60 can also be outputted from the controller 70 through the output port (not shown), through I/F 79.

Figure 6:
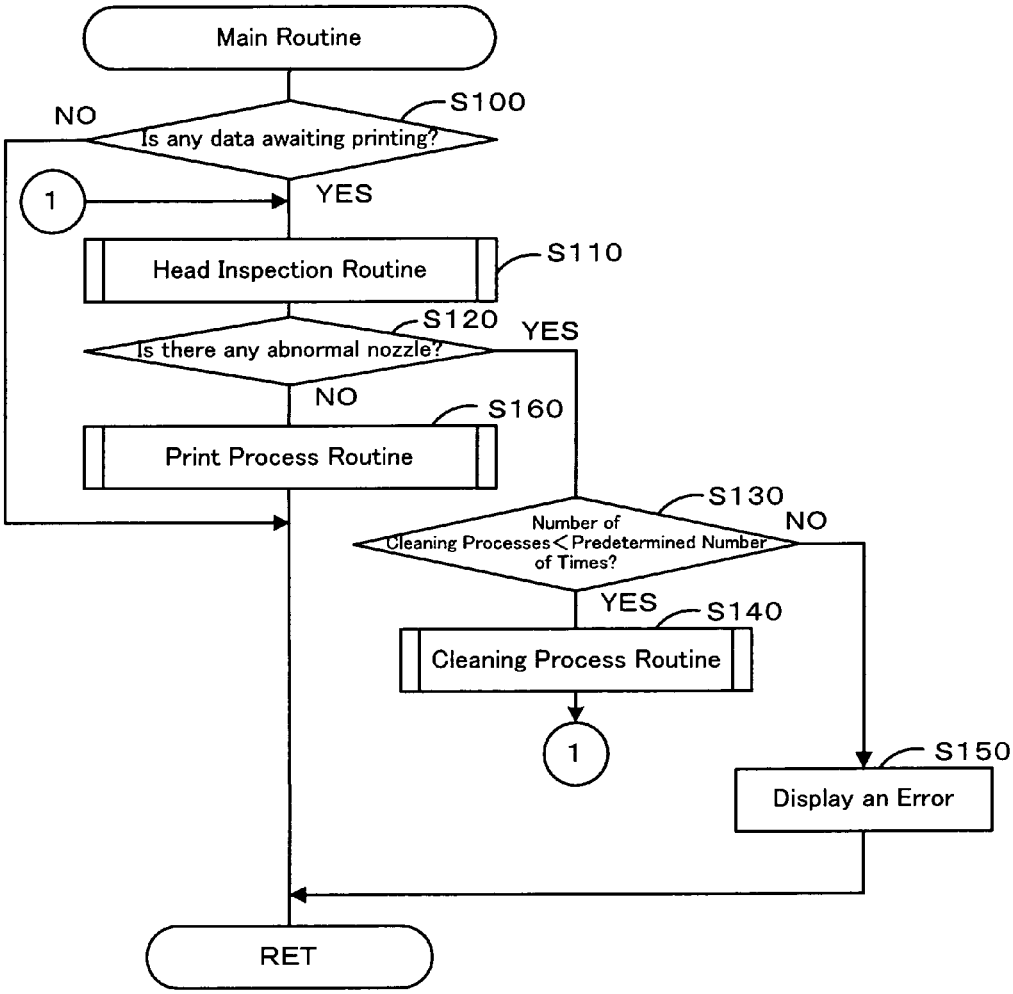
FIG. 6 is a flow chart of a main routine.

Next, an operation of an ink jet printer 20 of this embodiment thus configured will be described. First an operation of the main routine based on FIG. 6 will be described. FIG. 6 is a flow chart of the main routine executed by CPU 72 of the controller 70. After the ink jet printer 20 has been turned on, this routine is repeatedly executed by the CPU 72 at predetermined timings (for instance, every msec). When this routine begins, the CPU 72 judges first of all whether or not any print job is awaiting printing (Step S100). As a print job received from the user PC 60 is stored in the print buffer area formed in the RAM 74 and becomes a print job awaiting printing, at a time that a print job is received, when printing is under way, and even when printing can take place immediately, any print job becomes a print job awaiting printing. Moreover, if in step S100 no print job is awaiting printing, the main routine directly ends.

Figure 7:
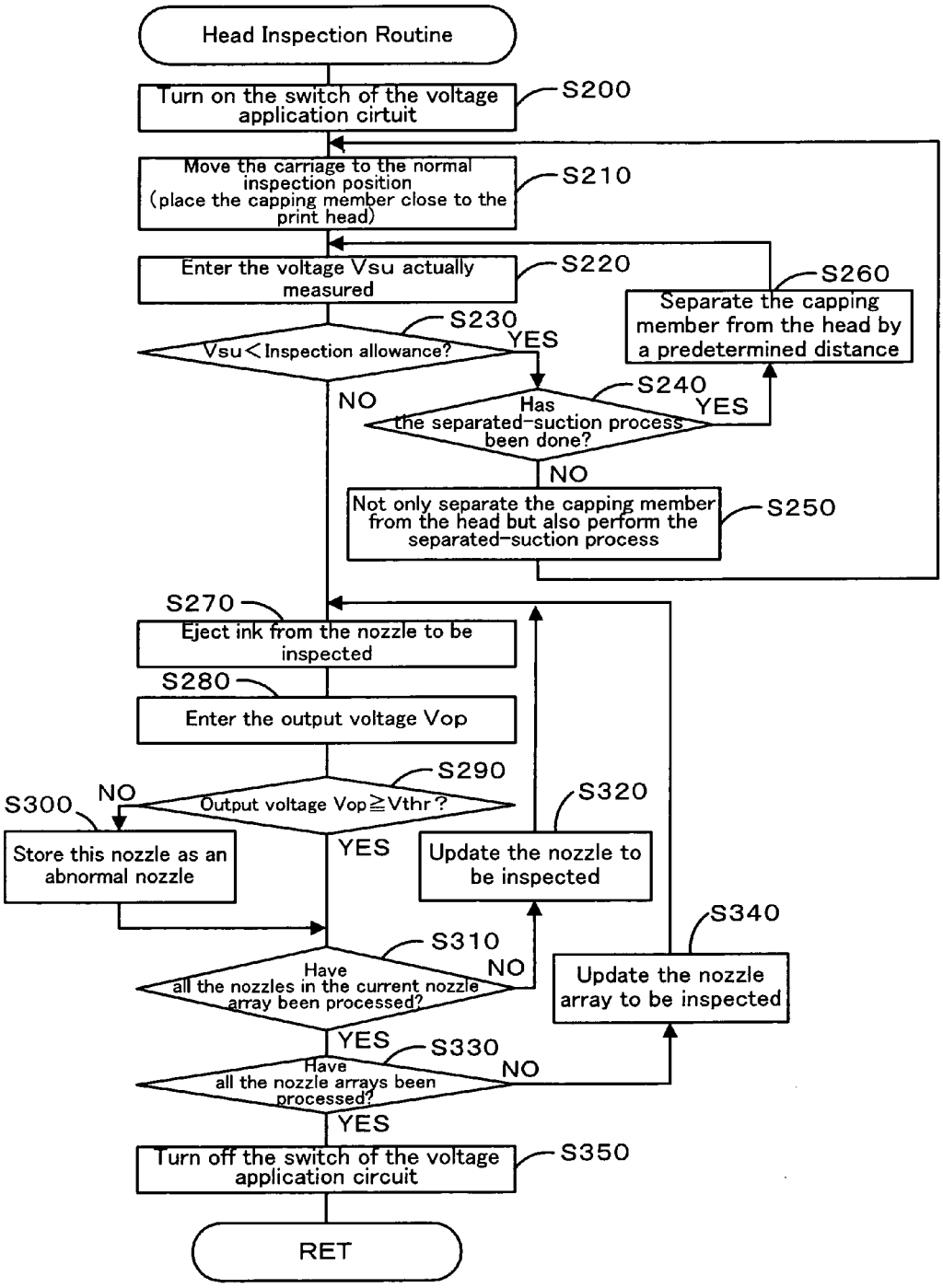
FIG. 7 is a flow chart of a head inspection routine.

On the one hand, if in Step S100, any print job is awaiting printing, the head inspection routine is executed for inspecting whether or not ink has been ejected normally from the individual nozzles 23 (Step S110). FIG. 7 is a flow chart of the head inspection routine. When the head inspection routine begins, the CPU 72 first of all turns on the switch SW of the voltage application circuit 53, generates a predetermined potential difference between the print head 24 and the inspection area 52 (Step S200) and drives the carriage motor 34*a* so as to move the carriage 22 in such a way that the print head 24 is in a normal inspection position (step S210). The normal inspection position is set as a position (also referred to as a home position. See FIG. 4(*c*)) at which the carriage 22 is located at the rightmost position of the guide 28, and the capping member 41 abuts the print head 24. When the carriage 22 is at the home position, the nozzle plate 27 is closest to the inspection area 52 (the nozzle plate 27 and the inspection area 52 are at their nearest distance from one another). Then, the CPU 72 enters a voltage Vsu that has actually been measured by the voltmeter 58 between the nozzle plate 27 and the inspection area 52 (Step S220), and judges whether or not the actual voltage Vsu is less than an inspection permissible range (Step S230). A relationship between the actually measured voltage Vsu are at which nozzle inspection has been carried out and accuracy of inspection based on the results of the nozzle inspection (for instance, a mistaken inspection rate of the nozzles 23 that reveals inspection results that are opposite to the conditions of the actual nozzles 23) can be determined, and on the basis of this relationship, the inspection permissible range is set at a range at which a satisfactory accuracy of inspection can be secured even if the actually measured voltage Vsu drops as a result of leakage of current. In this context, if ink ejected the nozzles 23 adheres to, and remains on the sealing member 42, or on the capping member 41, the nozzle plate and the inspection area 52 are shorted, resulting in a leakage of current, and voltage between the nozzle plate 27 and the inspection area 52 may drop. Further in these circumstances, such a drop in voltage caused by a factor such as a leakage of current can be judged. In addition, in this embodiment, as a sufficient resistance R1 is connected to the voltage amplifying circuit 53, the current will be weak even if there is leakage of current in the inspection area 52, etc., and thus safety can be ensured.

When the actually measured voltage Vsu is less than the inspection permissible range, the CPU 72 concludes that a major leakage of current has occurred in the inspection area 52, or elsewhere, and judges whether or not a separated-suction process has been carried out wherein the suction pump 45 is driven to pump out ink that has accumulated inside the capping member 41 without abutting the print head 24 and the capping member 41 (Step S240). If the separated-suction process has not yet been carried out, the CPU 72 not only separates the print head 24 from the capping member 41, but also carries out the separated-suction process (Step S250). In this context, by driving the carriage motor 34*a*, the CPU 72 separates the print head 24 and the capping member 41, by moving the carriage 22 to the left in FIG. 4(*c*). Then, the CPU 72 moves the carriage 22 so as to maintain a sufficient distance to prevent the print head 24 and the capping member 41 from coming into contact with ink. In addition, the separated-suction process is set so as to last for only a period that is sufficient to absorb ink inside the capping member 41. Then, at Step S210, the CPU 72 moves the carriage 22 so that the print head 24 reaches a normal inspection position. Since a shorter distance between the print head 24 and the capping member 41 results in an increase in strength of a signal that is obtained at the voltage detection circuit 54, and accuracy of nozzle inspection is thereby enhanced, in this embodiment, the CPU 72 moves the carriage 22 so that the print head 24 and the capping member 41 that were once positioned apart can once again abut one another and so that a nozzle inspection can be executed with the print head 24 and the capping member 41 as close as possible to one another. Then, after entering at Step S220 the actually measured voltage Vsu, the CPU 72 judges again at Step S230 whether or not the actually measured voltage Vsu is less than the inspection permissible range.

Figure 8:
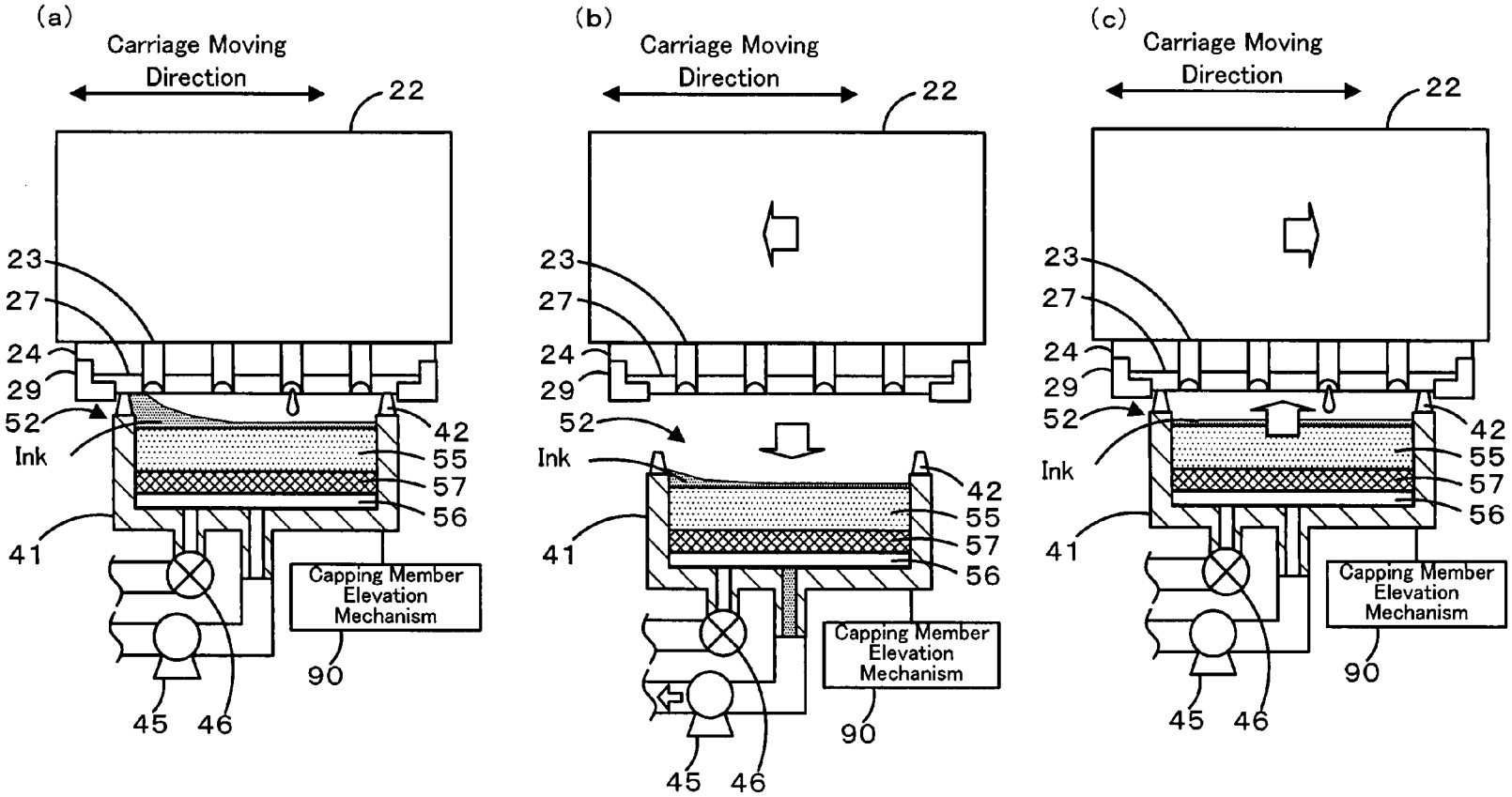
FIG. 8 is an illustration of a separated-suction process of the capping member 41, FIG. 8(*a*) is a view prior to the separated-suction process, FIG. 8(*b*) is a view during the separated-suction process, and FIG. 8(*c*) is a view after the separated-suction process.

Next, the processes of Steps S210 to S250 will be specifically described with reference to FIG. 8. FIG. 8 is an illustration of the separated-suction process of the capping member 41, FIG. 8(*a*) is a view prior to the separated-suction process, FIG. 8(*b*) is a view during the separated-suction process, and FIG. 8(*c*) is a view after the separated-suction process. As shown in FIG. 8(*a*), when at Step S210 the carriage 22 travels to the home position, the print head 24 and the capping member 41 make contact with each other by way of the sealing member 42. In this context, since the sealing member 42 is usually an insulator, no shorting occurs between the nozzle plate 27 and the inspection area 52. However, as ink remains in the capping member 41, leakage of a current will occur if ink contacts the nozzle-plate 27 and the inspection area 52, thus connecting them. Hence, voltage between the nozzle plate 27 and the inspection area 52 is detected by the voltmeter 58, and a nozzle inspection process (Steps S270 onwards) will be executed if the actually measured voltage Vsu detected is within the inspection permissible range that can ensure inspection accuracy of even when a leakage of current occurs. On the other hand, if the actually measured voltage Vsu is less than the inspection permissible range, as shown in FIG. 8(*b*), not only are the print head 24 and the capping member 41 spaced apart at Step S250, but the suction pump 45 is also driven to absorb and remove ink residing inside the capping member 41. Then, by moving the carriage 22 to the home position the print head and the capping member 41 are brought into contact. Further, because the amount of ink residing in the capping member 41 decreases, control can be exercised over shorting of the nozzle plate 27 and the inspection area 52 caused by ink.

If at Step S230 it is judged that the actually measured voltage Vsu is less than the inspection permissible range, and at Step S240 it is judged that the separated-suction process has been carried out, the CPU 72 concludes that leakage of current could not be controlled even through execution of a separated-suction process, and separates the capping member 41 to a predetermined distance from the print head 24 (Step S260). In this context, a value of the linear encoder 25 corresponding to the distance that the capping member 41 descends is stored in advance in the ROM 73, and by driving and controlling the carriage motor 34*a* on the basis of the value of this linear encoder 25, and by moving the carriage 22, the capping member 41 is separated from the print head 24 by only a predetermined distance. The predetermined distance may be a distance corresponding to the minimum distance traveled by the carriage 22. Moreover, the processes of S220 to S240 and S260 can be repeated until at Step S230 it is judged that the actually measured voltage Vsu is within the inspection permissible range. In other words, the capping member 41 will be repeatedly separated from the print head 24 by a predetermined distance, until it is judged that the actually measured voltage Vsu is within the inspection permissible range. If the actually measured voltage Vsu is not within the inspection permissible range, even when the distance between the print head 24 and the capping member 41 exceeds the predetermined inspection distance that can ensure accuracy of inspection, the CPU 72 concludes that by means of the operation of positioning the capping member 41 away from the print head 24, it cannot control a reduction in the level of an actually measured voltage Vsu, displays an error message to that effect on the operation panel (not shown), and terminates the routine.

Figure 9:
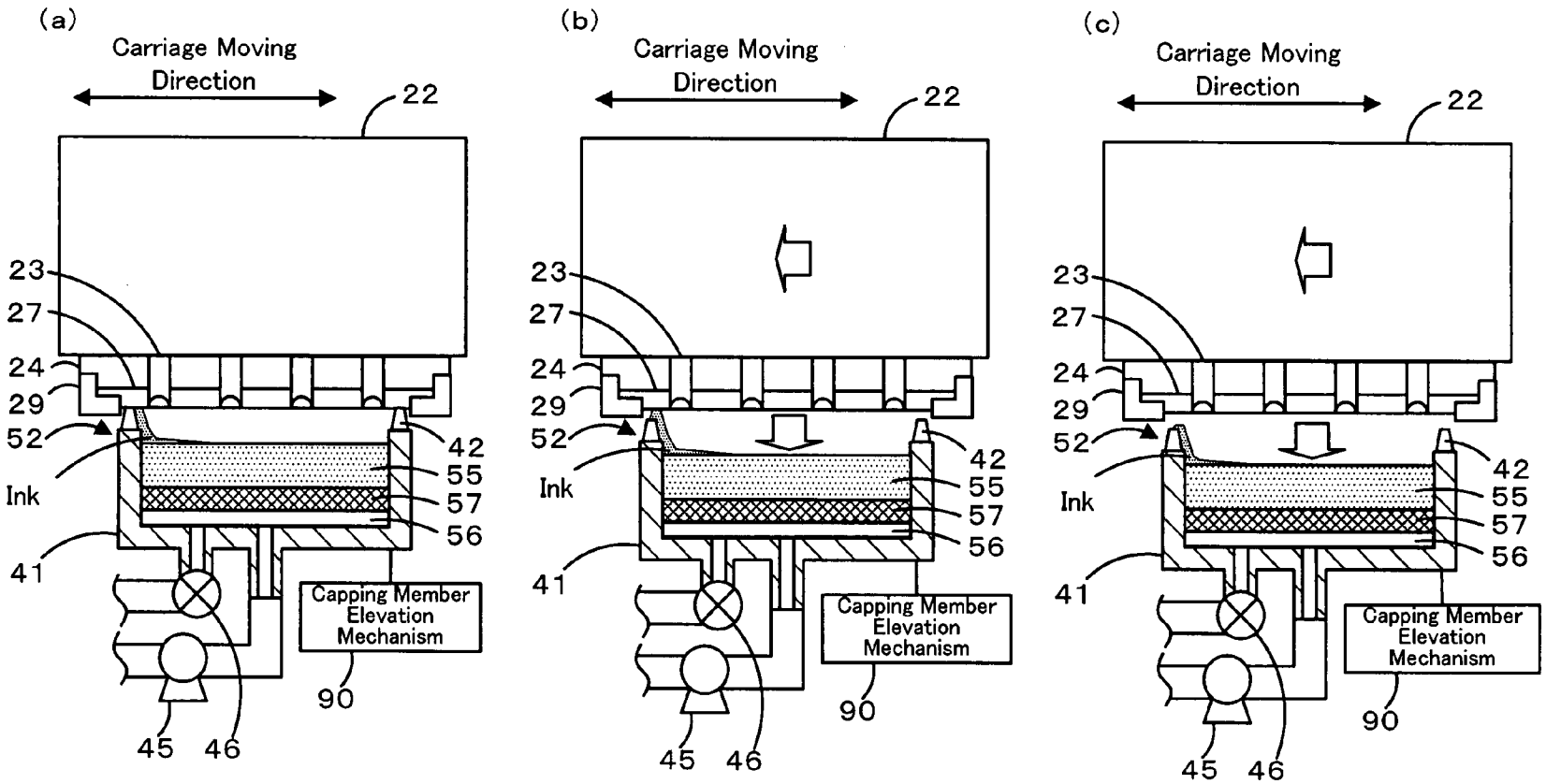
FIG. 9 is an illustration of positioning a capping member 41 separated from the print head 24, FIG. 9(*a*) is a view showing that the capping member 41 is in contact with the print head 24, FIG. 9(*b*) is a view showing of ink brought into contact with the capping member 41 and the print head 24, and FIG. 9(*c*) is a view showing of a capping member 41 completely separated from the print head 24.

Next, the processes of Steps S220 to 240, and S260 will be described with reference to FIG. 9. FIG. 9 is an illustration of positioning the capping member 41 away from the print head 24. FIG. 9(*a*) is a view of the capping member 41 and the print head 24 in contact, FIG. 9(*b*) is a view of the capping member 41 and the print head 24 in contact by way of ink, and FIG. 9(*c*) is a view of the capping member 41 and the print head 24 when they are spaced completely apart. As shown in FIG. 9(*a*), if any ink that cannot be sucked by the separated-suction process of Step S250 remains at a position such as on a wall surface of the sealing member 42, the ink may cause a leakage of current when the print head 24 and the capping member 41 are again brought into contact by way of the sealing member 42. In such a case, as shown in FIG. 9(*b*), the print head 24 and the capping member 41 are spaced apart for a predetermined distance. However, when the actually measured voltage Vsu is less than the inspection permissible range even if they are spaced apart, the print head 24 and the capping member 41 are further separated only by a predetermined distance. Then, as shown in FIG. 9(*c*), if the nozzle plate 27 and the inspection area 52 are no longer brought into contact by ink, the leakage of current will be eliminated and a voltage between the nozzle plate 27 and the inspection area 52 will be ensured.

On the one hand, if at Step S230 the actually measured voltage Vsu is not less than the inspection permissible range, in other words, if it is judged that the actually measured voltage Vsu is within the inspection permissible range, the CPU 72 performs a nozzle inspection of steps S270 to S340. Next, the nozzle inspection will be described. With the inspection area 52 grounded to the ground and voltage applied to the nozzle plate 27, an experiment of ejecting ink droplets from the nozzles 23 was actually conducted. At that time, the output signal waveform of the nozzle plate 27 was represented as a sine curve. Although the principle whereby such an output signal waveform was obtained is unknown, this can be attributed to the fact that as charged ink droplets approach the inspection area 52, an induced current runs due to electrostatic induction. In addition, the amplitude of the output signal waveform from the nozzle plate 27 not only depends on the distance from the print head 24 to the upper ink absorber 55 (inspection area 52), but also to the presence or otherwise, on flying ink droplets and sizes thereof. Thus, when ink droplets cannot fly out, or are smaller than a predetermined size because the nozzles 23 are clogged, in comparison with normal cases, the amplitude of the output signal waveform becomes smaller or almost zero. Thus, a judgment as to whether or not the nozzles 23 are clogged becomes possible on the basis of the amplitude of the output signal. In this embodiment, as the amplitude of an output signal waveform created by one shot of ink droplets was weak even when ink droplets were of a predetermined size, it was decided to eject 24 shots of ink droplets by performing an operation of outputting all of the first to third pulses P1, P2, P3 of one segment that was representative of a drive waveform. In this manner, the output signal became an integrated value for 24 shots of ink droplets, and a sufficiently large output signal waveform could be obtained from the voltage detection circuit 54.

When the nozzle inspection begins, the CPU 72 causes the nozzle 23, that is one of a nozzle array 43 that is a target of the inspection, i.e., the ink ejecting target, to eject ink through a masking circuit 47 and the piezoelectric device 48 thereof (See FIG. 2). (Step S270). Then, the CPU 72 enters the amplitude of the signal waveform detected by the voltage detection circuit 54, in other words the output voltage Vop (Step S280), and judges whether or not the output voltage Vop that has been entered is greater than a threshold Vthr (Step S290). The threshold Vthr is an empirically defined value that should not be exceeded by the output voltage Vop (peak value) of the output signal waveform when 24 shots of ink are normally ejected or, when the 24 shots of ink are not ejected normally that should not be exceeded due to noise, etc. If in Step S290 the output voltage Vop is less than the threshold Vthr, taking into consideration that abnormality such as clogging occurs at the nozzle 23, the CPU 72 stores in a predetermined area in the RAM 74, information specifying the nozzle 23 (information specifying for instance what nozzle in the nozzle array is involved) (Step S300).

When, after step S300, or at Step S290, the output voltage Vop exceeds the threshold Vthr (in fact, the nozzles 23 are normal at this time), the CPU 72 judges whether or not all of the nozzles 23 included in the nozzle array 43 currently being inspected have been inspected (Step S310). If any nozzle 23 in the nozzle array 43 at the time being inspected remains uninspected, the CPU 72 updates the nozzles 23 to be inspected with the uninspected nozzle (Step S320), and then executes the steps after Step S270. On the one hand, if in step S310 all the nozzles included in the nozzle array 43 at the time being inspected have been inspected, it is judged whether or not all the nozzle arrays included in the print head 24 have been inspected (Step S330). If any nozzle array 43 remains uninspected, the CPU 72 updates the nozzle array to be inspected with the nozzle array 43 that remains uninspected (Step S340), and then executes the processes after S270. On the other hand, if in Step S340 all the nozzle arrays 43 included in the print head 24 have been inspected, the CPU 72 turns off the switch SW of the voltage application circuit 53 (Step S350), and terminates the head inspection routine. By means of the execution of this routine, if any nozzle 23 among all the nozzles 23 arranged in the print head 24 is abnormal, information specifying that nozzle 23 is stored in a predetermined area of the RAM 74. No information is stored if none of the nozzles 23 is abnormal.

Next, referring back to the main routine of FIG. 6, after executing the head inspection routine described above (Step 110), the CPU 72 judges whether or not any nozzle 23 among all the nozzles arranged in the print head 24 is abnormal (Step S120). If any abnormal nozzle exists, the CPU 72 deems that clogging has caused the abnormality and cleans the print head 24. However before doing so, the CPU 72 judges whether or not the number of cleaning processes that need to be conducted to clear the abnormality has reached an upper limit (for instance, 3 times) (Step S130). Then, if the number of cleaning processes is less than the upper limit, the CPU 72 performs the cleaning process of the print head 24 (Step S140).

Figure 10:
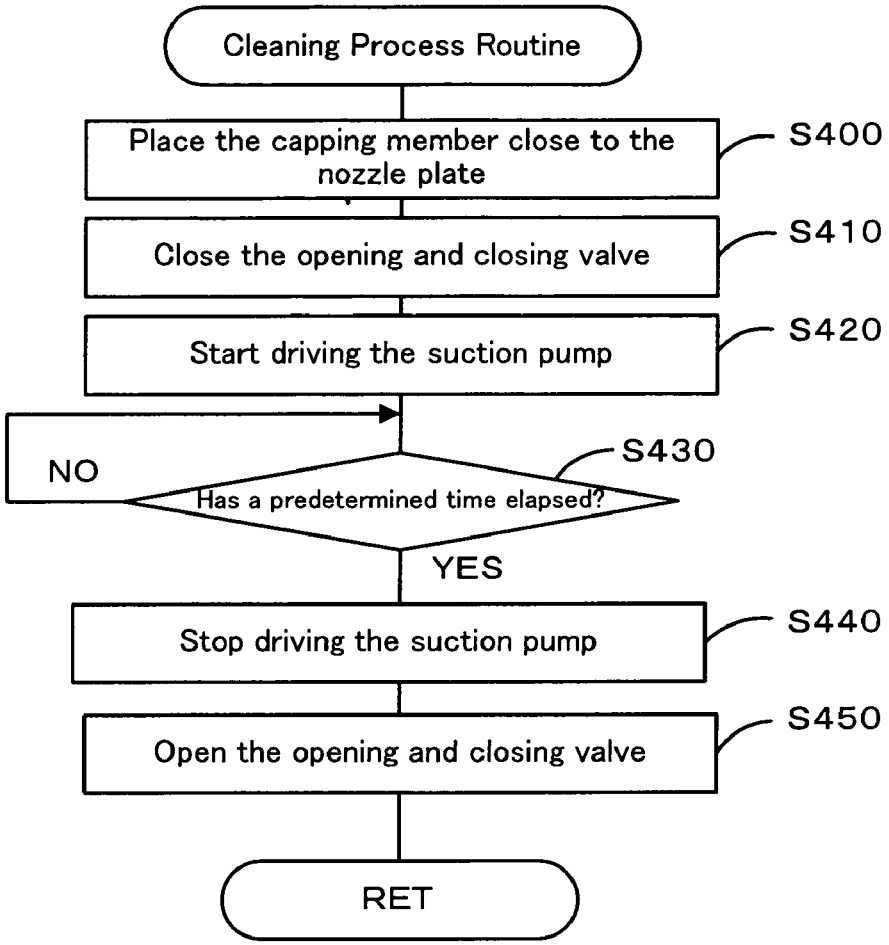
FIG. 10 is a flow chart of a cleaning process routine.

FIG. 10 is a flow chart of the cleaning process routine. When the cleaning process routine begins, as shown in FIG. 8(*c*), the CPU 72 places the capping member 41 close to the nozzle plate 27 by way of the sealing member 42, by driving the carriage motor 34*a* so that the carriage 22 is in a home position (Step S400). Then, the CPU 72 closes the opening and closing valve 46 (Step S410), and starts driving the suction pump 45 (Step S420). This generates negative pressure inside the capping member 41, resulting in ink in the nozzle 23 being absorbed. Then, the CPU 72 judges whether or not a predetermined time has elapsed (Step S430), and if the predetermined time has not elapsed simply waits. The predetermined time is a value set in advance as a result of experiments, etc., and has been stored in the ROM 73, as the time that facilitates an adequate suctioning of ink in the nozzle 23. On the other hand, if in step S430 the predetermined time has elapsed, the CPU 72 stops driving the suction pump 45 (Step S440), opens the opening and closing valve 46 (Step S450), and terminates the cleaning process routine. Execution of the cleaning process can remove ink that has accumulated in the nozzles 23 (for instance, ink of an increased viscosity because it has been neglected for a long time).

Next, returning to the main routine in FIG. 6, after performing the cleaning process, the CPU 72 returns to the head inspection routine at Step S110 to check whether or not the abnormality of the nozzle 23 has been rectified. In this step S110, although only on abnormal nozzle 23 may be re-inspected, all of the nozzles in the print head 24 are in fact re-inspected because nozzles that were normal during cleaning may for some reasons, be clogged. On the other hand, if the number of cleaning processes that have been conducted at Step S130 has reached an upper limit, the CPU 72 deems that cleaning cannot normalize the abnormal nozzle 23, displays an error message to that effect on the operation panel (not shown) (Step S150), and terminates the main routine. On the other hand, if at Step S120 no abnormal nozzle exists, the CPU 72 performs the print process routine (Step S160), and then terminates the main routine.

Figure 11:
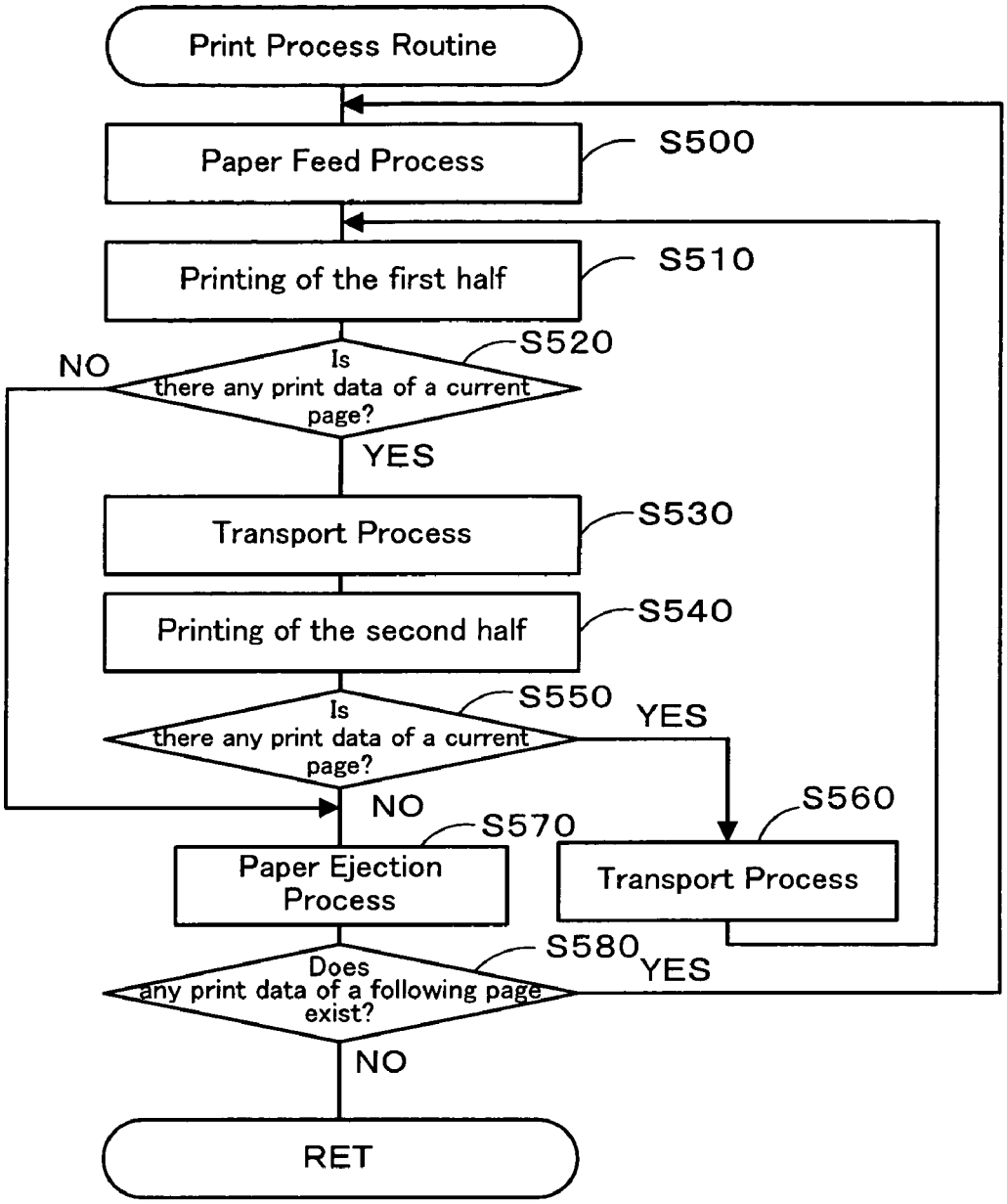
FIG. 11 is a flow chart of a print process routine.

FIG. 11 is a flow chart of the print process routine. When the print process routine begins, the CPU 72 first performs a paper feed process (Step S500). The paper feed process rotates and drives a paper feed roller 36 (see FIG. 3) by driving the driving motor 33, and transports to the paper handling roller 35 a recording sheet S that has been placed on the paper feed tray 38. Then, by driving the carriage motor 34*a*, the CPU 72 causes the print head 24 to eject ink, while moving the carriage 22 from the home position to the left in FIG. 1, and performs the first half of the printing on the basis of the printing data (Step S510). Next, the CPU 72 judges whether or not any print data needs to be printed on the recording sheet S that is now being printed (Step S520). If any data to be printed on the recording sheet S now being printed exists, the CPU 72 performs a transport process of rotating and driving the paper handling roller 35, and transporting the recording sheet S for a predetermined distance (Step S530), causes the print head 24 to eject ink while moving the carriage 22 to the right, in FIG. 1, by driving the carriage motor 34*a*, and performs the second half of the printing on the basis of the printing data (Step S540). Next, the CPU 72 judges whether or not any print data to be printed on the recording sheet that is now being printed (Step S550) exists. If any data to be printed on the recording sheet S now being printed exists, the CPU 72 executes the transport process of rotating and driving the paper handling roller 35, and transporting the recording sheet S for a predetermined distance (Step S560), and performs the processes after Step S510. On the other hand, if in Step S520 or Step S550 no print data to be printed on the recording sheet now being printed exists, the CPU performs the paper ejection process of processing the recording sheet S (Step S570). The paper ejection process rotates and drives the paper ejection roller 37 and ejects the recording sheet S to the catch tray. Then, the CPU 72 judges whether or not there is any print data of a page following Step S570 exists (Step S580). If any print data of a following page exists, the CPU 72 again returns to Step S500. If no print data of a following page exists, the CPU 72 terminates the print process routine. Thus, with accuracy of inspection ensured, the CPU 72 can perform nozzle inspection reliably and perform a printing process in a condition in which ink can be ejected from all the nozzles 23.

Next, the relationship between components of the present embodiment and those of the present invention will be described. The nozzle plate 27 of this embodiment corresponds to the nozzle-forming member of the present invention. The inspection area 52 corresponds to the print recording receiving area. The capping member elevation mechanism 90 corresponds to the distance-varying module. The masking circuit 47 and the piezoelectric device 48 correspond to the drive module. The voltage application circuit 53 corresponds to the potential difference generation module. The voltmeter 58 corresponds to the potential difference detection module. The voltage detection circuit 54 corresponds to the electrical change detection module. The suction pump 45 and the opening and closing valve 46 correspond to the negative pressure generation module. The CPU 72 corresponds to the control module. In this embodiment, one example of the print head inspection method of the present invention will also be clarified by describing an operation of the ink jet printer 20.

According to the ink jet printer 20 of this embodiment described in detail, when, in a condition in which a predetermined potential difference is generated between the nozzle plate 27 and the inspection area 52, an actually measured voltage Vsu detected by the voltmeter 58 is within the inspection permissible range, nozzle inspection is performed by sequentially generating, on the basis of the output voltage Vop detected by the voltage detection circuit 54 pressure in every nozzle 23. When the actually measured voltage Vsu detected by the voltmeter 58 is outside the inspection permissible range, a relative distance between the nozzle plate 27 and the inspection area 52 is increased, and nozzle inspection is then performed when the actually measured voltage Vsu is less than the inspection permissible range. Then, when a leakage of current occurs as a result of ink contacting the nozzle plate 27 and the inspection area 52, voltage between the nozzle plate 27 and the inspection area 52 may not reach an expected value. In general, when a potential difference generated between the nozzle plate 27 and the inspection area 52 decreases, an electric field between the nozzle plate 27 and the inspection area 52 may be weakened, and thus the level of output voltage Vop occurring in the inspection area 52 will be lower, thus, reducing the degree of accuracy of the nozzle inspection. Hence, the present invention sets in advance an inspection permissible range of voltage between the nozzle plate 27 and the inspection area 52, and performs nozzle inspection even when the actually measured voltage Vsu detected by the voltmeter 58 falls below a normal value, provided that it is within the inspection permissible range. When the actually measured voltage Vsu detected is less than the inspection permissible range, a distance between the nozzle plate 27 and the inspection area 52 is increased. Execution of this operation of clearing the condition in which the nozzle plate 27 and the inspection area 52 are in contact by way of ink controls reductions in voltage between the nozzle plate 27 and the inspection area 52. Consequently, a nozzle inspection can be performed with a stable degree of accuracy. In addition, even if the actually measured voltage Vsu between the nozzle plate 27 and the inspection area 52 is lower than the normal voltage, if it is within the inspection permissible range, accuracy of inspection can be ensured, and thus nozzle inspection can be carried out with a degree of certitude.

In addition, after an operation of increasing the relative distance between the nozzle plate 27 and the inspection area 52 has been performed, a nozzle inspection is performed in the normal inspection position (home position) at which the print head 24 is close to the inspection area 52, so as to obtain a higher output voltage Vop, accuracy of nozzle inspection can be easily ensured. Furthermore, accuracy of nozzle inspection can also be ensured easily, because the capping member elevation mechanism 90 is operated when the actually measured voltage Vsu is less than the inspection permissible range, and, after the actually measured voltage Vsu is less than the inspection permissible range, nozzle inspection is performed with the nozzle plate 27 and the inspection area 52 as close as possible to one another.

In addition, as the inspection area 52 is provided inside the capping member 41, ink ejected during a nozzle inspection can be easily disposed of, and after nozzle inspection, cleaning of the nozzles 23 can be performed promptly. In addition, as the suction pump 45 and the opening and closing valve 46 are controlled in such a way that negative pressure can be generated in the capping member 41 when the actually measured voltage Vsu is below the inspection allowance, ink that resides in the inspection area 52 inside the capping member 41 and that contacts the nozzle plate 27 and the inspection area 52 can be removed. This process makes it relatively easy to control reduction in the actually measured voltage Vsu. In addition, as in general the capping member 41 is configured so as to approach or move away from the nozzle plate 27, use of the capping member elevation mechanism 90 of this invention can eliminate the need to provide a new mechanism of this type.

In addition, it goes without saying that the present invention is not limited to the embodiments described above, but can be carried out in a variety of aspects provided that they remain within the technical scope of the invention.

For instance, in the embodiment described above, after the capping member 41 has been separated from the print head 24 and in Step S250 of the head inspection routine in FIG. 7 the separated-suction process has been performed on one occasion, the capping member 41 is gradually separated from the print head 24 until the actually measured voltage Vsu is within the inspection permissible range. However, the separated-suction process in Step S250 may be omitted. Thus, as the process in Step S260 of separating the capping member 41 gradually from the print head 24 is performed, shorting of the nozzle plate 27 and the inspection area 52 can be eliminated. Alternatively, the separated-suction process may be performed after in Step S250 the capping member 41 has been separated from the inspection area 52, and then the process of bringing the capping member 41 into contact with the print head 24 and detecting the actually measured voltage Vsu may be repeated more than once until such time as the actually measured voltage Vsu is within the inspection permissible range. Even when this method is used, the separated-suction process can control the reduction in the actually measured voltage Vsu. At this time, the process in Step S260 of separating the capping member 41 gradually from the print head 24 may be omitted.

In the embodiment described above, although in Step S250 the separated-suction process is performed and the capping member 41 is maintained at a satisfactory distance from the print head 24, the capping member 41 may be separated from the print head 24 to only a modest degree, and the suction process performed in such a way that pressure inside the capping member 41 is negative, thus preventing ink from being sucked from the nozzles 23. As negative pressure inside the capping member 41 increases, residual ink within the capping member 41 can be easily removed. Alternatively, the suction process may be performed with the print head 24 brought into contact with the capping member 41 by way of the sealing member 42.

In the embodiment described above, after the capping member 41 has been separated from the print head 24 in Step S250 of the head inspection routine and the separated-suction process has been performed, although in Step S260 the capping member 41 is separated gradually from the print head 24 until the actually measured voltage Vsu is within the inspection permissible range, a distance by which the capping member 41 is separated from the print head 24 may be defined on the basis of the actually measured voltage Vsu detected by the voltmeter 58, and if the actually measured value Vsu is less than the inspection permissible range in Step S230, the capping member 41 may be separated from the print head 24 by only the distance that has been defined. At this time, the relative distance may be defined in such a way that it will tend to increase as the level of an actually measured voltage Vsu becomes lower. In this way, the relative distance may be defined in relation to a potential difference between the nozzle plate 27 and the inspection area 52, and a potential difference between the nozzle plate 27 and the inspection area 52 can easily be made to be within permissible range. Alternatively, when the actually measured voltage Vsu is less than the inspection permissible range, the capping member 41 and the print head 24 may be separated by a distance that is defined on the basis of the actually measured voltage Vsu, and then a nozzle inspection process may be directly performed without resorting to Steps S240 to S260. At this time, the distance by which the capping member 41 is separated from the print head 24 may also be defined by empirically determining a relationship between the level of an actually measured voltage Vsu that has fallen more than in a normal case and a distance that is within the inspection permissible range at the actually measured voltage Vsu.

In the embodiment described above, although a judgment is made as to whether or not the actually measured voltage Vsu is less than the inspection permissible range with the print head 24 and the capping member 41 abutting, in order to control more effectively a leakage of current caused adhesion of ink, a judgment may be made as whether or not the actually measured voltage Vsu is less than the inspection permissible range with the print head 24 and the capping member 41 separated by only a predetermined distance. The predetermined distance may be empirically defined so as to be a distance that is as short as possible and distance at which leakages of current can be more effectively controlled.

Although the embodiment described above describes a capping member elevation mechanism 90 for positioning the inspection area 52 either close to, or separated from the nozzle plate 27, a print head elevation mechanism for positioning the print head 24 close to, or separated from the inspection area 52 may also be adopted. In general terms, since in some cases the configuration may be such that the height of the print head 24 is varied so as to be able to print on print media of varying thicknesses, the configuration may be used as a distance-varying module of the present invention. Furthermore, the configuration may comprise both a capping member elevation member 90 for placing the inspection area 52 close to, or separated from, the nozzle plate 27 and a print head elevation mechanism for positioning the print head 24 close to, or separated from, the inspection area 52.

In the embodiment described above, although a capping member elevation mechanism 90 has been described in which the capping member 41 approaches, or moves away from, the print head 24 as the carriage 22 travels from side to side, the embodiment need not be limited to this, in particular, as long as the mechanism can move the capping member 41 vertically. For instance, a capping member elevation mechanism may be adopted according to which the capping member 41 is located at the home position, and a slider that vertically slides the linear guide by means of a ball screw causes the capping member 41 to ascend and descend only vertically. By these means, the inspection area 52 can be positioned close to, or separated from the nozzle plate 27.

In the embodiment described above, although the actually measured voltage Vsu is within the inspection permissible range as the capping member elevation mechanism 90 separates the print head 24 and the capping member 41, a nozzle inspection may be performed only when the actually measured voltage Vsu is within the inspection permissible range. By these means, a nozzle inspection can be performed with a stable degree of accuracy. Even when this method is used, as long as the actually measured voltage Vsu is within the inspection permissible range, the embodiment need not be specifically limited to one that separates the print head 24 and the capping member 41. For instance, the actually measured voltage Vsu may be within the inspection permissible range by performing the cleaning process without separating the print head 24 and the capping member 41, by removing any ink that has adhered between the print head 24 and the inspection area 52, and by eliminating a leakage of current. Thus, by these means not only can the frequency of nozzle inspections be increased, but also nozzle inspections can be performed with a stable degree of accuracy.

Figure 12:
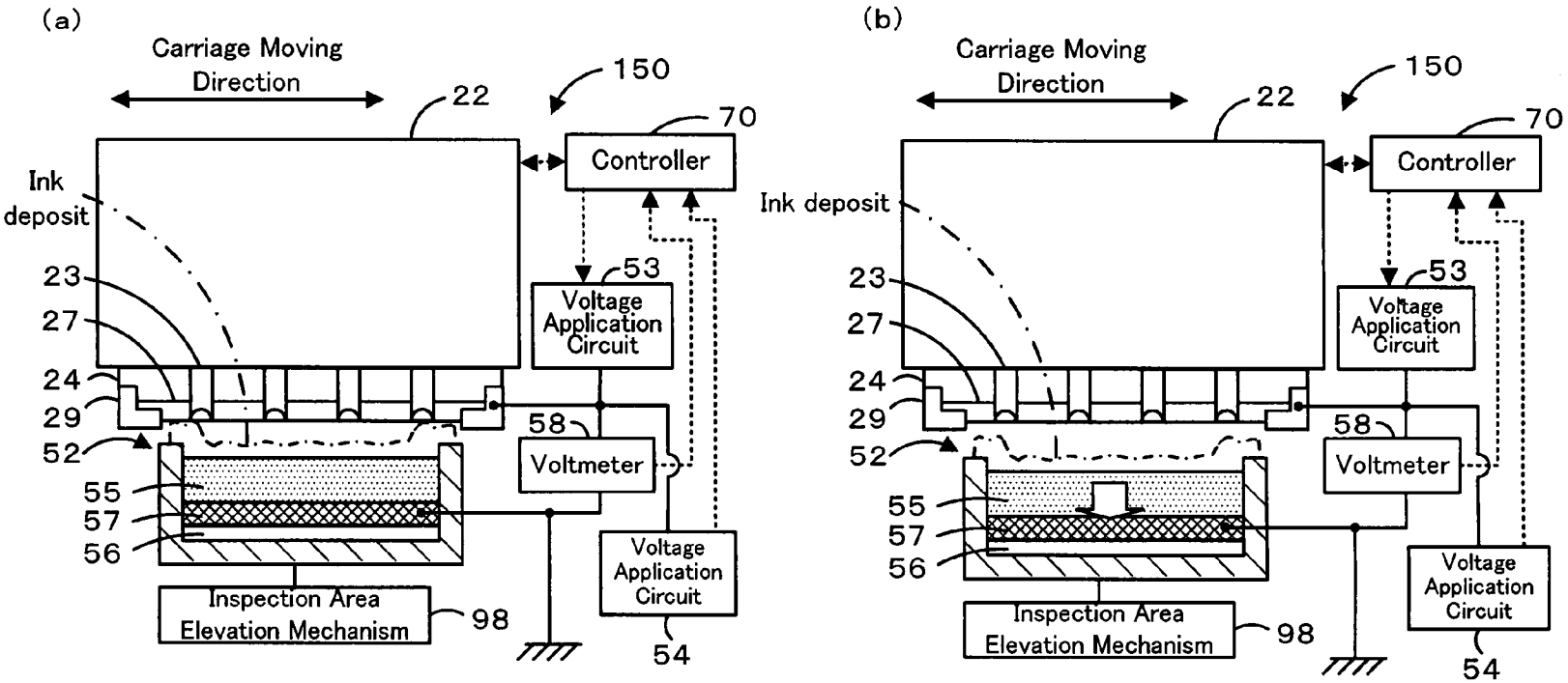
FIG. 12 is an illustration of another print head inspection apparatus 150, FIG. 12(*a*) is a view of a nozzle plate 27 and an inspection area 52 are shorted, and FIG. 12(*b*) is a view showing that the nozzle plate 27 and the inspection area 52 are released from the shorting.

In the above embodiment, although a print head inspection apparatus 50 located inside the capping member 41 has been described, as shown in FIG. 12, it may also be a print head inspection apparatus 50 in which the inspection area 52 is positioned in any location other than inside the capping member 41 (for instance, in the neighborhood of the flashing area 49). FIG. 12 is an illustration of another print head inspection apparatus 150, FIG. 12(*a*) is a view of a nozzle plate 27 and an inspection area 52 that has been shorted, and FIG. 12(*b*) is a view of a situation in which the shorting of the nozzle plate 27 and the inspection area 52 have been eliminated. A configuration that is identical to that of the ink jet printer 20 described above may be given same symbols, and a description thereof omitted. As the inspection area elevation mechanism 98 for raising and lowering the inspection area 52, one similar to the one in the embodiment described above may be adopted or a mechanism that enables the inspection area 52 to ascend and descend only straight up and down may be adopted. When printing or nozzle inspections are performed several times, deposits of constituents contained in ink accumulate in the inspection area 52. If the amount of ink deposits increases, as shown in FIG. 12(*a*), an ink deposit in the inspection area 52 comes into contact with the nozzle plate 27, resulting in leakages of current and causing a reduction in the level of voltage between the nozzle plate 27 and the inspection area 52. At this time, as shown in FIG. 12(*b*), a nozzle inspection may be performed after separating the inspection area 52 from the print head 24 until the actually measured voltage Vsu is within the inspection permissible range. In this way a reduction in the level of the voltage between the nozzle plate 27 and the inspection area 52 can be controlled and a nozzle inspection can be performed with a stable degree of accuracy. In addition, in the embodiment described above, although a reduction of the actually measured voltage Vsu was attributed to leakages of current caused by ink residing in the capping member 41, the causes need not be limited to this, and leakages of current may occur for any reason as long as they occur as a result of shorting of the nozzle plate 27 and the inspection area 52, such as ink deposits that have accumulated in the inspection area 52.

Alternatively, a print head inspection apparatus may be provided wherein the inspection area 52 is located in the flashing area 49. In such a case, a judgment may be made as to whether or not the actually measured voltage Vsu is less than the inspection permissible range, without positioning the inspection area 52 in the flashing area 49 close to the print head 24, or alternatively, by positioning the inspection area 52 in the flashing area 49 close to the print head 24. At this time, as described above, the configuration may be such that the print head 24 is positioned close to, or separated from the flashing area 49, or the flashing area 49 is placed close to, or separated from the print head 24. In addition, if a judgment is made to the effect that the actually measured voltage Vsu is less than the inspection permissible range, the print head 24 may be moved to the home position, and after a cleaning process has been performed by the capping device 40 to eliminate leakages of current, a judgment may be made as to whether or not the actually measured voltage Vsu is less than the inspection allowance.

In the above embodiment, although a judgment is made as whether or not the actually measured voltage Vsu is less than the inspection permissible range with the nozzle plate 27 of the print head 24 in contact with the sealing member 42 of the capping member 41, the nozzle plate 27 may have electrical insulation properties, and the actually measured voltage Vsu may be checked with the nozzle plate 27 and the inspection area 52, either in contact or closer to one another. If the actually measured voltage Vsu is within the inspection permissible range, a nozzle inspection may be performed in that condition. As this makes possible for the print head 24 to approach the inspection area 52, a nozzle inspection can be performed with a higher degree of accuracy. In addition, in order to insulate the nozzle plate 27, the surface of the nozzle plate 27 may be coated with an insulating material, or the nozzle plate 27 may be made of an insulating material.

In the embodiment described above, although in Step S100 the head inspection routine is executed at Step S110 when any print data is awaiting printing of the main routine, the head inspection routine may be executed every time the frequency of movement by the carriage 22 reaches a predetermined frequency (for instance, every 100 passes), or at predetermined intervals (such as every other day or every other week), or alternatively, the need inspection routine may be executed in response to an instruction from a user to execute, by means of the operation panel (not shown). In addition, the head inspection routine may be executed at a time of inspection prior to shipment of the ink jet printer 20.

In the embodiment described above, although the capping member 41 caps the nozzle plate 27 and the suction pump 45 sucks during the cleaning process, the capping member 41 may cap the nozzle plate 27 at any time other than the cleaning process, such as during halts between printing. In such circumstances, the suction pump need not suction and capping may serve simply to prevent drying.

Although, in the embodiment described above, a configuration is such that the voltage detection circuit 54 detects an output signal waveform of the nozzle plate 27, instead of, or in addition to, the voltage detection circuit 54, a similar voltage detection circuit may be connected between the electrode member 57 and the ground, so as to detect output signal waveforms from the inspection area 52. In such circumstances, when during a nozzle inspection a potential difference is generated between the inspection area 52 and the nozzle plate 27, either the inspection area 52 may be grounded to the ground, and voltage applied to the nozzle plate 27, or the nozzle plate 27 may be grounded to the ground, and voltage applied to the inspection area 52.

Although, in the embodiment described above, a method has been adopted of the ink jet printer of printing while the print head 24 is traveling in the main scanning direction, a so-called line printer (see JP-A-2002-200779, for instance) may be adopted wherein the print head is formed fully across the print area in a width direction of the print medium. In such circumstances, the platen supporting recording sheets to be transported may also be used as the inspection area, and the entire platen may be provided inside the capping member.

Although, in the embodiment described above, the upper ink absorber 55 and the lower ink absorber 56 are provided in the capping member 41, one or both of them may be omitted. For instance, the configuration may be such that only the electrode member 57 is located inside the capping member 41 and that ink is ejected directly onto the electrode member 57. In addition, as a predetermined difference is generated between ink in the nozzle plate 27 and the electrode member 57, the upper ink absorber 55 need not necessarily be conductive, and the upper ink absorber 55 may, for instance, be formed of an insulating material.

In the embodiment described above, a method has been adopted in which an ink jet printer 20 has been used, but a multi-function printer incorporating a scanner or a complex printer such as a FAX machine or a copier may also be used.

Japanese Patent Application No. 2005-333980 filed on Nov. 18, 2005 in Japan being incorporated herein by reference, the present specification incorporates all of the specifications, drawings, and claims respectively disclosed therein.

The invention claimed is:

1. A print head inspection method according to which inspects a print head in which a nozzle-forming member forming a plurality of nozzles is provided by utilizing a print head inspection apparatus comprising a print recording liquid-receiving area that can receive print recording liquid ejected from the nozzles, the print head inspection method including steps of:

(a) applying a predetermined voltage so as to generate a predetermined potential difference between the print recording liquid in the print head and the print recording liquid-receiving area;

(b) following step (a) detecting the potential difference between the print recording liquid in the print head and the print recording liquid-receiving area; and (c) when the potential difference detected in step (b) is within a predetermined permissible range, applying pressure sequentially to the print recording liquid in every nozzle, detected an electrical change in the print recording liquid in the print head, or in the print recording liquid-receiving area, and on the basis of the electrical change detected, performing a nozzle inspection so as to establish whether or not print recording liquid has been ejected from individual nozzle, wherein the print head inspection apparatus comprises a distance-varying module that is capable of varying a relative distance between the print recording liquid-receiving area and the nozzle-forming member, and wherein, when the potential difference detected in step (b) is less than the permissible range, step (c) is a step of performing the nozzle inspection after the distance-varying module has been controlled so as to increase the relative distance.

2. The print head inspection method according to claim 1, wherein, in a situation in which the predetermined potential difference has been generated between the print recording liquid in the print head and the print recording liquid-receiving area, and the nozzle-forming member and the print recording liquid-receiving area have in consequence assumed a normal inspection distance, when the potential difference detected in step (b) is less than the permissible range, step (c) is a step of controlling the distance-varying module so as to first increase the relative distance beyond the normal inspection distance and then restore it to the normal inspection distance, and, when the potential difference detected in step (b) is within the permissible range, of conducting the nozzle inspection at the normal inspection distance.

3. The print head inspection method according to claim 1 wherein, when the potential difference detected in step (b) is less than the permissible range, step (c) is a step of controlling the distance-varying module so as to increase the relative distance until the potential difference detected in step (b) is within the permissible range.

4. The print head inspection method according to claim 1 wherein, when the potential difference detected in step (b) is less than the permissible range, step (c) is a step of defining the relative distance in such a way that the less the potential difference detected in step (b) is, the more the relative distance tends to increase, and of controlling the distance-varying module so as to reach the relative distance determined.

5. The print head inspection method according to claim 1, wherein the print head inspection apparatus comprises a capping member that caps the nozzles by means of contact on the part of the nozzle-forming member, and a negative pressure generation module that generates negative pressure inside the capping member, wherein the print recording liquid-receiving area is provided inside the capping member, and the print head inspection method includes a step of:

(d) when results of the nozzle inspection indicate that the print recording liquid has not been ejected from the nozzles, after, by means of controlling the distance-varying module so that the capping member and the nozzle-forming member are brought into contact, capping the nozzle-forming member by means of the capping member, controlling the negative pressure generation module so that print recording liquid is sucked from the individual nozzle of the nozzle-forming member.

6. The print head inspection method according to claim 1, wherein:

the print head inspection apparatus comprises a capping member that caps the nozzles by means of contact on the part of the nozzle-forming member, and a negative pressure generation module that generates negative pressure inside the capping member, and wherein the print recording liquid-receiving area is provided in the capping member, the print head inspection method including a step of:

(e) when the potential difference detected in step (b) is less than the permissible range, controlling the negative pressure generating module so as to generate negative pressure in the capping member.

7. The print head inspection method according to claim 1, wherein:

the print head inspection apparatus comprises a capping member that caps the nozzles as by means of contact on the part of the nozzle-forming member, and a negative pressure generation module that generates negative pressure inside the capping member, and wherein the print recording liquid-receiving area is provided in the capping member, the print head inspection method including a step of:

(f) after controlling the distance-varying module in such a way that, when the potential difference detected in step (b) is less than the permissible range, the relative distance increases, controlling the negative pressure generation module so as to generate negative pressure on the capping member.

8. The print head inspection method according to claim1, wherein the distance-varying module is a module that positions the print recording liquid-receiving area close to, or separated from the nozzle-forming member.

9. The print head inspection method according to claim 1 wherein the distance-varying module is a module that positions the nozzle-forming member close to, or separated from the print recording liquid-receiving area.

10. A print head inspection apparatus for inspecting a print head in which is provided a nozzle-forming member forming a plurality of nozzles, the print head inspection apparatus comprising:

a print recording liquid-receiving area that can receive print recording liquid ejected from the nozzles;

a drive module that generates pressure on the print recording liquid in the print head;

a potential difference generation module that is capable of applying a predetermined voltage so that a predetermined potential difference is generated between the print recording liquid in the print head and the print recording liquid-receiving area;

a potential difference detection module that detects a potential difference between the print recording liquid in the print head and the print recording liquid-receiving area, an electrical change detection module that detects an electrical change in the print recording liquid in the print head, or in the print recording liquid-receiving area, a control module that, when a potential difference detected by the potential difference detection module is within a predetermined permissible range while a predetermined level of voltage is applied by the potential difference generation module so as to generate the predetermined potential difference between the print recording liquid in the print head and the print recording liquid-receiving area, controls the drive module so that pressure is generated sequentially on the print recording liquid in individual nozzle and performs a nozzle inspection, on the basis of electrical change detected by the electrical change-detection module, in order to establish whether or not print recording liquid has been ejected from each individual nozzle, a distance-varying module that is capable of varying a relative distance between the print recording liquid-receiving area and the nozzle-forming member, and wherein, when the potential difference detected by the potential difference detection module is less than the permissible range, the control module performs the nozzle inspection after the distance-varying module has been controlled so as to increase the relative distance.

11. a printer comprising:

a print head in which a nozzle-forming member forming a plurality of nozzles is provided, and the print head inspection apparatus according to claim 10.

12. The print head inspection apparatus according to claim 10, wherein, in a situation in which the predetermined potential difference has been generated between the print recording liquid in the print head and the print recording liquid-receiving area by the potential difference generation module controlled by the control module, and the nozzle-forming member and the print recording liquid-receiving area have, in consequence, assumed a normal inspection distance, when the potential difference detected by the potential difference detection module is less than the permissible range, the control module controls the distance-varying module so as to first increase the relative distance beyond the normal inspection distance and then restore it to the normal inspection distance, and, when the potential difference detected by the potential difference detection module is within the permissible range, conducts the nozzle inspection at the normal inspection distance.

13. The print head inspection apparatus according to claim 10, wherein, when the potential difference detected by the potential difference detection module is less than the permissible range, the control module controls the distance-varying module so as to increase the relative distance until the potential difference detected by the potential difference detection module is within the permissible range.

14. The print head inspection apparatus according to claim 10, wherein, when the potential difference detected by the potential difference detection module is less than the permissible range, the control module defines the relative distance in such a way that the less the potential difference detected by the potential difference detection module is, the more the relative distance tends to increase, and controls the distance-varying module so as to reach the relative distance determined.

15. The print head inspection apparatus according to claim 10, wherein the print head inspection apparatus comprises a capping member that caps the nozzles by means of contact on the part of the nozzle-forming member, and a negative pressure generation module that generates negative pressure inside the capping member, wherein the print recording liquid-receiving area is provided inside the capping member, and when results of the nozzle inspection indicate that the print recording liquid has not been ejected from the nozzles, after the control module controls the distance-varying module so that the capping member and the nozzle-forming member are brought into contact, caps the nozzle-forming member by means of the capping member, controls the negative pressure generation module so that print recording liquid is sucked from the individual nozzle of the nozzle-forming member.

16. The print head inspection apparatus according to claim 10, further comprising a capping member that caps the nozzles by means of contact on the part of the nozzle-forming member, and a negative pressure generation module that generates negative pressure inside the capping member, and wherein the print recording liquid-receiving area is provided in the capping member, and wherein when the potential difference detected by the potential difference detection module is less than the permissible range, the control module controls the negative pressure generating module so as to generate negative pressure in the capping member.

17. The print head inspection apparatus according to claim 16, wherein, after the control module controls the distance-varying module in such a way that, when the potential difference detected by the potential difference detection module is less than the permissible range, the relative distance increases, and controls the negative pressure generation module so as to generate negative pressure on the capping member.

18. The print head inspection apparatus according to claim 10, wherein the distance-varying module is a module that positions the print recording liquid-receiving area close to, or separated from, the nozzle-forming member.

19. The print head inspection apparatus according to claim 10, wherein the distance-varying module is a module that positions the nozzle-forming member close to, or separated from, the print recording liquid-receiving area.

* * * * *